US011986028B2

(12) United States Patent
Wong

(10) Patent No.: US 11,986,028 B2
(45) Date of Patent: May 21, 2024

(54) EQUESTRIAN PANTS GARMENTS

(71) Applicant: Ariat International, Inc., San Leandro, CA (US)

(72) Inventor: Mimie Wong, Alameda, CA (US)

(73) Assignee: Ariat International, Inc., San Leandro, CA (US)

( * ) Notice: Subject to any disclaimer, the term of this patent is extended or adjusted under 35 U.S.C. 154(b) by 135 days.

(21) Appl. No.: 17/687,317

(22) Filed: Mar. 4, 2022

(65) Prior Publication Data

US 2022/0354192 A1 Nov. 10, 2022

Related U.S. Application Data

(60) Provisional application No. 63/184,966, filed on May 6, 2021.

(51) Int. Cl.
*A41D 1/086* (2018.01)

(52) U.S. Cl.
CPC ..... *A41D 1/086* (2013.01)

(58) Field of Classification Search
CPC . A41D 1/06; A41D 1/08; A41D 1/082; A41D 1/084; A41D 1/086; A41D 2400/38;
(Continued)

(56) References Cited

U.S. PATENT DOCUMENTS 4,698,847 A * 10/1987 Yoshihara ..... A41C 1/06 450/7
4,946,453 A * 8/1990 Monson ..... A41D 31/18 604/312

(Continued)

FOREIGN PATENT DOCUMENTS

| | | |
|---|---|---|
| CA | 2521593 C | 8/2012 |
| EP | 2491802 A1 | 8/2012 |
| TW | M602348 U | 10/2020 |

OTHER PUBLICATIONS

CW-X Endurance Generator Joint & Muscle Support Compression Tight, accessed on Apr. 16, 2021 from: https://cw-x.com/product/endurance-generator-tights-women/?attribute_pa_color=011&attribute_pa_size=xs.

(Continued)

*Primary Examiner* — Heather Mangine

(74) *Attorney, Agent, or Firm* — Kolitch Romano Dascenzo Gates LLC; David S. D'Ascenzo

(57) ABSTRACT

Equestrian pants garments that include rider-specific body-mapped compression panels for muscle and joint support and/or stabilization while riding or performing other activities. Hip abductor support panels, knee stabilization panels, and a lumbar panel may be formed with layers of a mesh textile combined with a base textile. Each leg portion of the pants garment may include a respective hip abductor support panel and knee stabilization panel, while the lumbar panel may extend across both leg portions on the posterior side of the pants garment. Calf panels in each leg portion may be formed using just the mesh textile, for compression combined with increased breathability in the area of the equestrian's calves. Support panels of equestrian pants garments may be sized and positioned so as to avoid the equestrian's inner knee area, and instead may wrap around to the outer knee area.

24 Claims, 7 Drawing Sheets

(58) Field of Classification Search
CPC ..... A41D 2400/80; A41D 13/0015; A41D 13/0005; A41D 31/18; A41D 31/185
See application file for complete search history.

(56) References Cited

U.S. PATENT DOCUMENTS 5,109,546 A * 5/1992 Dicker ..... A41D 13/0015 482/121
5,263,923 A * 11/1993 Fujimoto ..... A41D 19/01582 602/62
D504,553 S 5/2005 Ota et al.
D505,769 S * 6/2005 Ota ..... D2/742
D505,770 S * 6/2005 Ota ..... D2/742
D507,858 S 8/2005 Ota et al.
D508,304 S 8/2005 Ota et al.
D513,830 S 1/2006 Ota et al.
D514,280 S 2/2006 Ota et al.
D520,715 S 5/2006 Ota et al.
D529,686 S * 10/2006 Ota ..... D2/742
7,730,552 B2 6/2010 Ota et al.
D625,900 S * 10/2010 Morii ..... D2/742
D632,461 S * 2/2011 Morii ..... D2/742
8,533,864 B1 * 9/2013 Kostrzewski ..... A41D 13/0015 2/69
D693,989 S 11/2013 Tanaka et al.
9,144,252 B1 * 9/2015 Kostrzewski ..... A41D 1/08
9,456,641 B1 * 10/2016 Mignone ..... A41D 31/185
D820,563 S * 6/2018 Glynn ..... D2/853
11,213,082 B1 * 1/2022 Yang ..... A41D 1/08
2003/0101506 A1 * 6/2003 Fujii ..... A41D 1/08 2/240
2004/0255358 A1 * 12/2004 Ota ..... A41D 31/18 2/69
2006/0130215 A1 * 6/2006 Torry ..... A41D 13/065 2/227
2006/0143800 A1 * 7/2006 Deffner ..... A41D 1/088 2/234
2006/0169004 A1 * 8/2006 Belluye ..... A41D 31/18 66/177
2006/0230488 A1 * 10/2006 Rudolph ..... A41D 1/086 2/69
2007/0033696 A1 * 2/2007 Sellier ..... A61H 7/001 2/69
2008/0120757 A1 * 5/2008 Nakazawa ..... A41D 31/18 2/22
2009/0007311 A1 * 1/2009 Semba ..... A41D 31/12 2/243.1
2009/0113596 A1 * 5/2009 Young ..... A41D 1/00 602/61
2009/0320189 A1 * 12/2009 Raghuprasad ..... A41D 13/02 182/9
2010/0130903 A1 * 5/2010 Rock ..... D04B 1/243 602/62
2010/0167626 A1 * 7/2010 Hamlet ..... A41D 31/12 450/95
2011/0271415 A1 * 11/2011 Torry ..... A41D 1/08 2/23
2011/0314590 A1 12/2011 Perron et al.
2012/0100778 A1 * 4/2012 Cho ..... A41D 1/06 450/95
2012/0233752 A1 * 9/2012 Kemma ..... A41D 13/0525 2/69
2013/0219579 A1 * 8/2013 Molyneux ..... A41D 13/012 2/2.15
2013/0254971 A1 * 10/2013 Galluzzo ..... A41D 1/00 2/400
2013/0316617 A1 * 11/2013 Freddi ..... A41D 31/18 450/95
2013/0326785 A1 * 12/2013 Cornacchiari ..... A41D 1/00 2/69
2014/0115747 A1 * 5/2014 Spruill ..... A41D 13/0015 2/22
2014/0230124 A1 * 8/2014 Wilms-Otto ..... A41D 31/18 2/69
2014/0366585 A1 * 12/2014 Shen ..... D04B 21/207 66/175
2015/0074865 A1 * 3/2015 Yamada ..... A41D 13/065 2/69
2015/0107000 A1 * 4/2015 Tanaka ..... A41D 1/08 2/227
2016/0021942 A1 * 1/2016 Vauge-Lalanne ..... A41D 31/18 2/401
2016/0174622 A1 * 6/2016 Lo ..... A41D 31/00 2/227
2016/0295933 A1 * 10/2016 Herbener ..... A41D 27/20
2016/0338424 A1 * 11/2016 Kehler ..... A41D 13/0015
2016/0339286 A1 * 11/2016 Kehler ..... A41D 31/18
2017/0238621 A1 * 8/2017 Blibech ..... A41B 9/00
2018/0279694 A1 * 10/2018 Theno ..... A41B 9/12
2018/0325188 A1 * 11/2018 Burhance ..... A41F 9/00
2018/0325196 A1 * 11/2018 Miller ..... D06M 23/16
2019/0029345 A1 * 1/2019 Marchetto ..... A41D 27/24
2019/0045856 A1 * 2/2019 Musciacchio ..... A41D 7/00
2019/0075858 A1 * 3/2019 Noonan ..... A41D 31/185
2019/0133216 A1 * 5/2019 Durham ..... A41D 1/08
2019/0239579 A1 * 8/2019 Stricker ..... A63B 23/0482
2019/0254852 A1 * 8/2019 Ryndziewicz ..... A61F 5/0104
2020/0120999 A1 * 4/2020 Mason ..... A41C 1/02
2021/0037902 A1 * 2/2021 Johnson ..... A41D 13/0015
2021/0059864 A1 * 3/2021 Reilly ..... A61F 13/08
2021/0227898 A1 * 7/2021 Tanaka ..... A41D 7/00
2021/0267284 A1 * 9/2021 Wong ..... A41D 31/18
2021/0298396 A1 * 9/2021 Lazic ..... A41F 9/00
2022/0047004 A1 * 2/2022 Betts ..... A63B 21/4009
2022/0241100 A1 * 8/2022 Eom ..... A41D 1/067
2022/0354192 A1 * 11/2022 Wong ..... A41D 1/086

OTHER PUBLICATIONS

English language translation of TW M602348 U, downloaded from: patents.google.com on Jun. 14, 2022.
"What is Power Mesh Fabric?", Fabrics by the Yard, [online], retrieved from: https://www.fabricsyard.com/print-by-the-yard-blog/what-is-power-mesh-fabric/, Oct. 9, 2019.

* cited by examiner

EQUESTRIAN PANTS GARMENTS

RELATED APPLICATION

This application claims priority to U.S. Provisional Patent Application No. 63/184,966, which was filed on May 6, 2021, and the complete disclosure of which is hereby incorporated by reference.

FIELD

The present disclosure relates to pants garments. More particularly, the present invention relates to compression pants garments for equestrians.

BACKGROUND

Many athletes wear compression garments after or during physical exertion, such as during athletic training or competition. Different types of compression garments have many different purported benefits, such as providing muscle support, aiding in muscle recovery, enhancing performance, improving circulation, temperature regulation, stabilizing joints, and/or preventing chafing or rashes. Compression pants garments, also referred to as compression tights, are form-fitting garments that, when worn, cover the athlete's waist, hips, thighs, and at least a portion of the lower legs.

Pants garments for equestrian use present particular challenges in design requirements, at least in part because the equestrian's body typically experiences substantially continuous changes in position and/or joint articulation while horseback riding. Grip, fabric stretch, rider comfort, and fit are important considerations in such garments. Rider comfort also includes consideration of friction between the rider and their saddle and/or between the rider and their horse, which can create rubbing and skin irritation, or chafing.

SUMMARY

Equestrian pants garments according to the present disclosure may include body-mapped zoning compression, and may be configured to integrate compression, tension, and support that targets muscle groups prone to injury and/or fatigue in equestrian riders. One example of the disclosed pants garments includes a right leg portion and a left leg portion, wherein each of the right leg portion and the left leg portion includes a number of panels particularly positioned and configured to provide additional compression and/or support to targeted muscle groups. For example, each leg portion of the pants garment may include a hip abductor support panel, a knee stabilization panel, and a calf panel. The pants garment also may include a lumbar panel positioned on a posterior side of the pants garment, and such lumbar panel may extend laterally across at least a portion of both the right leg portion and the left leg portion of the pants garment. The lumbar panel may be configured to provide compression and support to a lumbar region of the equestrian when the pants garment is worn by the equestrian.

Each hip abductor support panel may extend inferiorly from a waistband portion of the pants garment, with the hip abductor support panels being configured to provide compression and support to at least a portion of the equestrian's hip abductor muscle group when the pants garment is worn by the equestrian. Each knee stabilization panel may extend obliquely and/or inferiorly from an inner thigh of the equestrian to an outer knee area of the equestrian when the pants garment is worn by the equestrian, with each knee stabilization panel being configured to provide compression and support to a respective knee joint and quadriceps muscle of the equestrian when the pants garment is worn by the equestrian. Similarly, each calf panel may extend superiorly from a distal end region of each of the right leg portion and the left leg portion, with each calf panel being configured to provide compression and support to a respective calf muscle of the equestrian when the pants garment is worn by the equestrian.

Equestrian pants garments according to the present disclosure additionally or alternatively may include a right leg portion and a left leg portion that each include a first portion, a second portion, and a third portion. The first portion may be formed of a base textile, the base textile being a stretchable material that provides a first compressive force to the legs of the equestrian when the pants garment is worn. The second portion may be formed of a mesh textile without the base textile (and the first portion likewise may be just the base textile, without the mesh textile), the mesh textile being a second stretchable material. The third portion may be formed of the base textile overlaid with the mesh textile, such that the third portion provides a second compressive force to the legs of the equestrian when the pants garment is worn, the second compressive force being greater than the first compressive force provided by the first portion. The second portion may be configured to provide increased breathability to the equestrian's legs when the pants garment is worn, as compared to the first portion or the third portion. In some examples, the pants garment may be configured such that the second portion is at least substantially free from overlap with the first portion, and such that the third portion is at least substantially free from overlap with the first portion and the second portion.

DESCRIPTION

Figure 1:
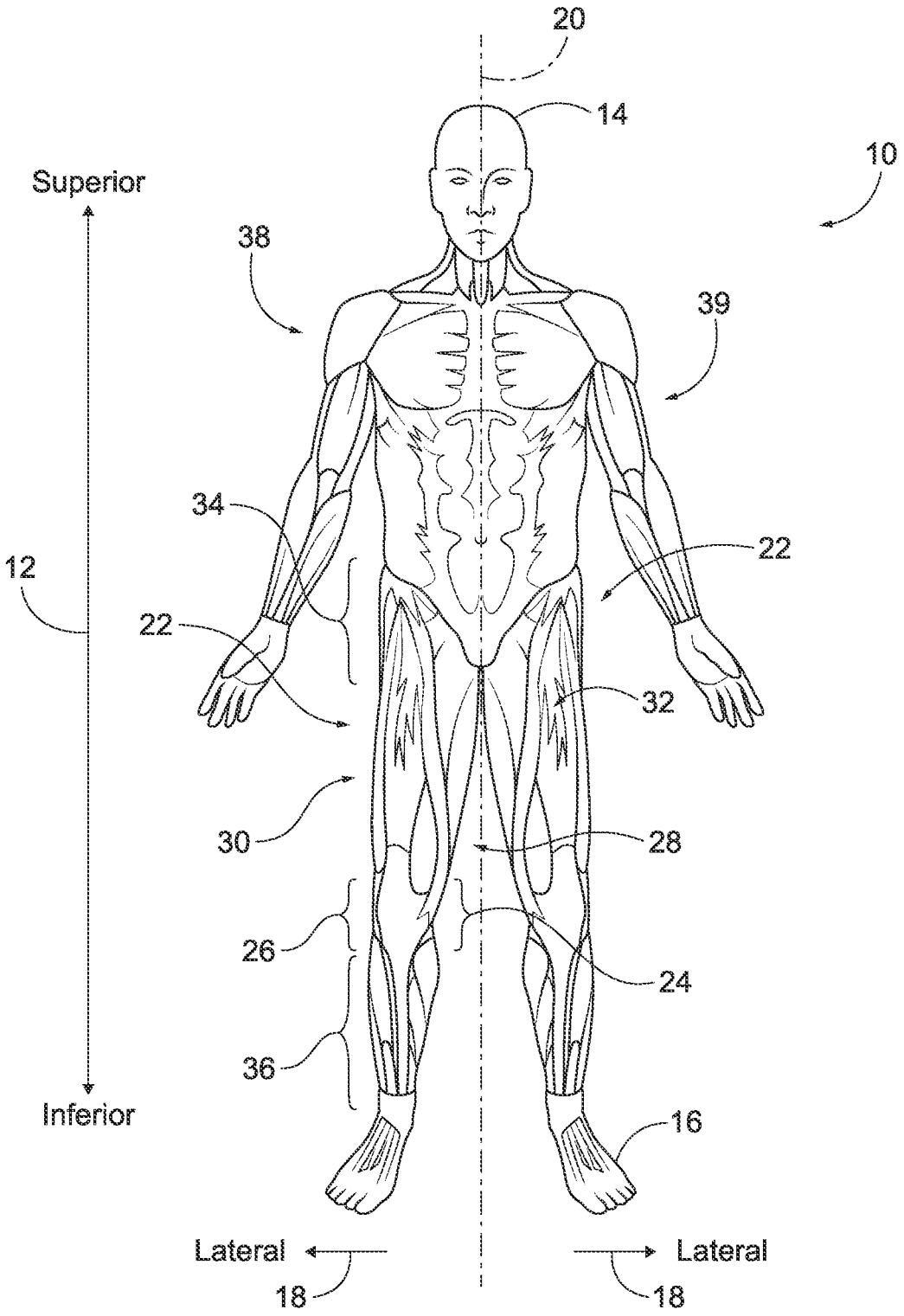
FIG. 1 is a representation of a human figure, providing generic musculature, anatomy, and reference direction indications for use in the specification.

FIG. 1 provides a general reference framework for discussion of presently disclosed pants garments herein, and FIG. 1 illustrates the general musculature, overall anatomy, and reference direction indications for an equestrian 10, or other wearer of the disclosed pants garments. As indicated by arrow 12, a first component or feature of the disclosed pants garments may be described as being superior relative to another component or feature, or relative to an aspect of equestrian 10, if the first component or feature is closer to the head 14 of equestrian 10. Similarly, a first component or feature of the disclosed pants garments may be described as being inferior relative to another component or feature, or relative to an aspect of equestrian 10, if the first component or feature is closer to the feet 16 of equestrian 10.

As indicated by arrows 18, a first component or feature of the disclosed pants garments may be described as being lateral to another component or feature, or to an aspect of equestrian 10, if the first component or feature is closer to a side 22 of equestrian 10 than is the other component or feature. Likewise, a first component or feature of the disclosed pants garments may be described as being medial to another component or feature, or to an aspect of equestrian 10, if the first component or feature is closer to an imaginary centerline 20 of equestrian 10 than the other component or feature. Put another way, a first component or feature is medial to a second component or feature if the first component or feature is closer to imaginary centerline 20 than the second component or feature is, whereas a first component or feature is lateral to a second component or feature if the first component or feature is closer to a given side 22 than the second component or feature is. Thus, generally, if a first component or feature is lateral to a second component or feature, then the second component or feature will likewise be medial to the first component or feature.

Areas of the equestrian's legs that may be referred to herein include an inner knee area 24, an outer knee area 26, an inner thigh area 28, and an outer thigh area 30. Thigh muscles, or quadriceps, are generally indicated at 32, and the hip abductor muscle group is generally indicated at 34, and may include the gluteus medius, the gluteus minimus, the tensor fasciae latae, the piriformis, and/or the sartorius. The equestrian's calf muscle area is generally indicated at 36. The terms "proximal" and "distal" may be used herein with respect to the equestrian's extremities, with a feature being described as being distal to, or distal of, another feature if it is further from a torso 39 of equestrian 10. For example, the knee is distal to the hips, and the foot is distal to both the hips and the knee. Similarly, the knee is proximal to the foot because the knee is closer to torso 39 of equestrian 10 than is the foot. FIG. 1 illustrates the anterior side of equestrian 10, while the posterior side is generally indicated at 38, and commonly referred to as the back side of a person's body. While the wearer of disclosed pants garments will be referred to herein as an equestrian, it is within the scope of the present disclosure that disclosed pants garments may be worn by anyone of any age or gender, even if not for equestrian purposes. Aspects and features of the disclosed pants garments similarly will be described herein with reference to support and compression for particular muscle groups and target areas of particular relevance to equestrians 10, though disclosed pants garments also may be used for other activities and/or the concepts disclosed herein may be adapted to create pants garments specifically tailored for other athletes, sports, or activities.

Figure 2:
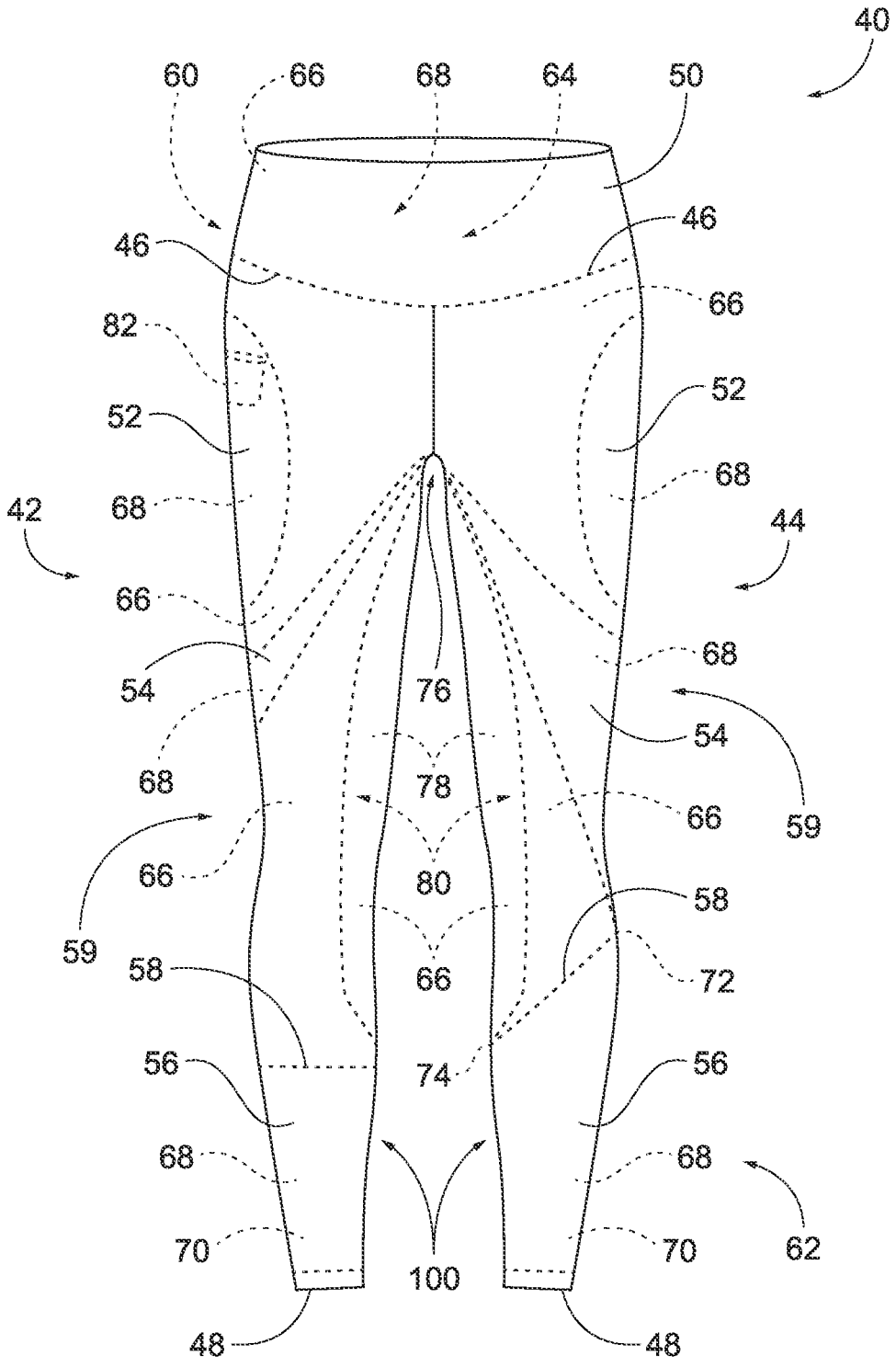
FIG. 2 is a schematic representation of examples of pants garments according to the present disclosure, shown from the front of the pants garment.

FIG. 2 shows a schematic representation of nonexclusive examples of pants garments 40 according to the present disclosure. Generally in the figures, elements that are likely to be included in a given example are illustrated in solid lines, while elements that are optional to a given example are illustrated in broken lines. The broken lines used to represent panels and features in the schematic representation of FIG. 2 are not intended to limit the scope of pants garments 40 to those particular shapes and contours, but merely to generally indicate areas of reference that may take on a plurality of different shapes, sizes, and contours in various examples of pants garment 40. Similarly, the overall perimeter of the representation of pants garment 40 is intended to be illustrative, and various examples of pants garments 40 may have different proportions, shapes, etc., without departing from the scope of the present disclosure. Additionally, elements that are illustrated in solid lines are not essential to all examples of the present disclosure, and an element shown in solid lines may be omitted from a particular example without departing from the scope of the present disclosure.

As detailed herein, pants garment 40 may include body-mapped zoning compression (e.g., zoning reinforced compression), and may be configured to integrate compression, tension, and support that targets muscle groups prone to injury and/or fatigue in equestrian riders. Overall, pants garment 40 may be configured to aid in return of blood flow, create moderate vascular compression within the equestrian's body, optimize performance, and/or aid in muscle recovery for the equestrian, and thus may be configured to provide rider-focused protection for the equestrian, such as increased comfort and/or support while riding. Pants garment 40 generally includes a right leg portion 42 and a left leg portion 44, with right leg portion 42 generally being positioned to surround or envelop at least a portion of the equestrian's right leg when pants garment 40 is worn, and left leg portion 44 generally being positioned to surround or envelop at least a portion of the equestrian's left leg when pants garment 40 is worn. Each of right leg portion 42 and left leg portion 44 may extend from a respective proximal edge region 46 to a respective distal edge region 48. Proximal edge region 46 of each of right leg portion 42 and left leg portion 44 may be adjacent and/or coupled to a waistband portion 50 of pants garment 40. Waistband portion 50, as is well understood in the art, is generally configured to be positioned about the equestrian's waist, hips, abdomen, and/or lower torso when pants garment 40 is worn by equestrian 10. As right leg portion 42 and left leg portion 44 may extend to waistband portion 50, right leg portion 42 and left leg portion 44 may, in some cases, be positioned on a portion of the equestrian's pelvic region and/or lower abdomen or torso, depending on the proportions of pants garment 40 relative to those of the equestrian wearing them. Distal edge regions 48 of right leg portion 42 and left leg portion 44 also may correspond to a lower end, or distal end, of pants garment 40 as a whole, though in some examples pants garment 40 may include additional features distal to distal edge regions 48, such as stirrups or feet portions configured to cover or engage with the equestrian's feet, shoes, or boots, when pants garment 40 is worn. Pants garment 40 is generally configured as a garment intended to cover at least a portion of the wearer's legs, and may include pants, tights, leggings, and/or breeches.

Each of right leg portion 42 and left leg portion 44 may include a hip abductor support panel 52, a knee stabilization panel 54, and a calf panel 56. Such hip abductor support panels 52, knee stabilization panels 54, and calf panels 56 may be configured to provide regional zones of increased compression that are mapped to specific areas of the equestrian's body when pants garment 40 is worn, thereby providing body-mapped muscular and/or joint support. In some examples, hip abductor support panels 52, knee stabilization panels 54, and/or calf panels 56 may be configured to extend such that they overlie areas of the equestrian's leg between ligaments (thereby "connecting" the ligaments) and/or overlie one or more muscles end-to-end, such that each respective panel may be positioned over the length of said muscles and/or over ligaments of the equestrian when pants garment 40 is worn. For example, knee stabilization panels 54 may be sized and positioned to overlie a portion of the quadriceps muscle and extend across the lateral collateral ligament at the outer knee area 26 of the equestrian's knee, thereby providing support and stability to the equestrian's knee. Additionally or alternatively, hip abductor support panels 52, knee stabilization panels 54, and/or calf panels 56 may be sized, shaped, and positioned relative to the equestrian's legs while pants garment 40 is worn such that hip abductor support panels 52, knee stabilization panels 54, and/or calf panels 56 traverse across one or more of the equestrian's muscles, joints, and/or ligaments, thereby providing support and compression transversely to joints and musculature in this manner.

Sizes (e.g., lengths, widths, shapes, etc.) of hip abductor support panels 52, knee stabilization panels 54, and/or calf panels 56 may vary depending on where they are positioned on pants garment 40, the size of pants garment 40, and/or the intended targeted muscle group and/or ligaments. The schematic representation of hip abductor support panels 52, knee stabilization panels 54, and calf panels 56 in FIG. 2 is not intended to represent any exact spacing, proportions, designs, or contours of these panels. Instead, the schematic representation is intended to indicate examples of possible shapes or general positioning. For example, the representation of knee stabilization panel 54 on right leg portion 42 is shown as narrower and shorter than the representation of knee stabilization panel 54 of left leg portion 44, merely to represent that many variations in shapes, sizes, and positions of such knee stabilization panels 54 are within the scope of the present disclosure. As another example, the representation of calf panel 56 on right leg portion 42 is shown having a relatively horizontal proximal edge region 58, while proximal edge region 58 of calf panel 56 of left leg portion 44 is angled, which again is intended merely to represent that variations of shapes, sizes, and positions of such calf panels 56 is within the scope of the present disclosure. Generally, proximal edge regions 58 of calf panels 56 will be substantially symmetrical on right leg portion 42 and left leg portion 44, but FIG. 2 illustrates that variations in the arrangement of proximal edge region 58 are within the scope of the examples of pants garment 40 presently disclosed. While examples of pants garment 40 will typically be substantially symmetrical overall, some examples of pants garment 40 may be asymmetrical, such that one or more panels on right leg portion 42 is different in some manner than one or more panels on left leg portion 44, and/or such that right leg portion 42 differs from left leg portion 44 in another way. In some examples, pants garment 40 may be configured to be asymmetrical to accommodate, for example, equestrians with certain disabilities, and/or equestrians with variations in leg size or length. Additionally or alternatively, pants garment 40 may be customized (and asymmetrical, in some instances) to accommodate injuries in a particular equestrian rider and/or to accommodate equestrian activities that by their nature result in greater or lesser forces to be applied to one of the equestrian's legs than the other.

Hip abductor support panels 52 are configured to provide compression and support to at least a portion of the equestrian's hip abductor muscle group when the pants garment is worn by the equestrian. In some examples, hip abductor support panels 52 may be configured to reduce fatigue in these muscles, which may aid the equestrian in maintaining stability in the saddle when pants garment 40 is worn. Said hip abductor support panels 52 may be spaced apart from waistband portion 50, or may extend inferiorly from waistband portion 50. In other words, hip abductor support panels 52 may meet waistband portion 50, and may extend away from waistband portion 50, generally distally towards distal edge regions 48 of right leg portion 42 and left leg portion 44. In some examples, hip abductor support panels 52 may be positioned such that at least a portion of hip abductor support panels 52 are present on a front, or anterior, portion 62 of pants garment 40, though in some examples, hip abductor panels 52 may not be directly visible when viewing pants garment 40 from the front. Additionally or alternatively, hip abductor support panels 52 may be positioned on lateral sides 59 of pants garment 40 and/or on a posterior side 60 of pants garment 40. Hip abductor support panels 52 may be positioned and sized to overlie at least a portion of the iliotibial band, biceps femoris, tensor fasciae latae, gluteus medius, and/or gluteus maximus.

Knee stabilization panels 54 are configured to provide compression and support to a respective knee joint and/or quadriceps muscle of the equestrian when pants garment 40 is worn by the equestrian. In some examples, knee stabilization panels 54 may be configured to provide support to the equestrian's groin and top of the thigh, which may help the equestrian maintain their position on a moving horse by supporting and/or reducing fatigue in these muscle groups.

Each knee stabilization panel 54 may extend interiorly from inner thigh region 28 (FIG. 1) of the equestrian wearing pants garment 40, and transversely towards outer knee area 26, passing across, or traversing, at least a portion of the equestrian's thigh. For example, each respective knee stabilization panel 54 may be sized and positioned to traverse across the equestrian's respective rectus femoris, vastus lateralis, vastus medialis, vastus intermedius, and/or sartorius muscle.

Knee stabilization panels 54 may be curved or may be formed of straight or angled portions. Knee stabilization panels 54 may have a substantially constant width across the length of each knee stabilization panel 54, or knee stabilization panels 54 may vary in width as they extend from the inner thigh to the outer knee region of the equestrian. For example, knee stabilization panels 54 may have a thinner width where they meet the equestrian's inner thigh 28 (FIG. 1) than in other areas of knee stabilization panel 54, such as where they cross the equestrian's thighs. The width of knee stabilization panels 54 may be reduced as they wrap around the outer knee region of the equestrian's legs, though in other examples, the width may increase or stay substantially the same in the outer knee region 26 (FIG. 1).

In some examples, at least a portion of each knee stabilization panel 54 may be configured to extend obliquely across one or more muscles of the quadriceps or thigh. As used herein, a feature may be said to extend "obliquely" if it does so in a manner that is not parallel or perpendicular to a reference object. For example, knee stabilization panels 54 may be said to extend obliquely across the equestrian's thighs when pants garment 40 is worn, because at least a portion of knee stabilization panels 54 may be shaped and positioned such that they are curved or angled (e.g., non-parallel and non-perpendicular) with respect to a major longitudinal axis of the equestrian's thigh. Pants garments 40 may be configured such that knee stabilization panels 54 are absent from inner knee region 24 of the equestrian's knees, which may be particularly advantageous when pants garment 40 is worn during horseback riding. In other words, knee stabilization panels 54 generally are configured to extend from an inner thigh region 28 superior to the equestrian's knee, to the outer knee region 26, or even inferior to the equestrian's knee, on the lateral sides of the equestrian's legs.

At least a portion of calf panels 56 generally are positioned on a posterior side 60 of pants garment 40, though are represented in FIG. 2 for illustrative purposes. Calf panels 56 generally extend superiorly from each distal edge region 48, though in some examples calf panels 56 may terminate proximal to distal edge regions 48. Each calf panel 56 may be configured to provide compression and support to a respective calf muscle of the equestrian when pants garment 40 is worn. Calf panels 56 may be sized and positioned to compress at least a portion of the equestrian's calf muscles, or substantially the entire calf muscle of each of the equestrian's legs. Calf panels 56 may wrap at least partially around leg portions 42, 44 such that they may be present on both posterior side 60 of pants garment 40 and anterior side 62 of pants garment 40, or calf panels 56 may just be present on posterior side 60 of pants garment 40. Proximal edge region 58 of calf panels 56 may extend inferiorly and obliquely from a lateral side 72 of each proximal edge region 58 to a medial side 74 of each proximal edge region 58, such as schematically illustrated in the example of calf panel 56 in left leg portion 44 of FIG. 2. Calf panels 56 may be substantially as wide as the equestrian's lower leg, and each calf panel 56 may extend from a respective lateral side 59 of each of the right leg portion 42 and left leg portion 44, to a respective medial side 100 of each of the right leg portion 42 and left leg portion 44. In other words, in some examples of pants garment 40, calf panels 56 may extend across substantially the entire width of right leg portion 42 and left leg portion 44 on posterior side 60 of pants garment 40, in the lower leg region of the equestrian's legs.

Pants garment 40 also may include a lumbar panel 64 positioned on posterior side 60 of pants garment 40. Lumbar panel 64 may extend laterally across both right leg portion 42 and left leg portion 44, and/or superior to right leg portion 42 and left leg portion 44. Lumbar panel 64 may be configured to provide compression and support to a lumbar and/or core region of the equestrian when pants garment 40 is worn by the equestrian. In some examples, lumbar panel 64 may form a portion of waistband portion 50, may extend along an edge of waistband portion 50, may be adjacent a portion of waistband portion 50, and/or may be positioned inferior to waistband portion 50. In some examples, lumbar panel 64 may extend to anterior side 62 of pants garment 40, although in some examples it is only present on posterior side 60. Lumbar panel 64 and/or waistband portion 50 may be configured to provide support to the equestrian's core, such as the rectus abdominis and/or the external obliques.

Waistband portion 50 may be sized and proportioned to provide a low-rise fit when worn by an equestrian, a mid-rise fit when worn by an equestrian, or a high-rise fit when worn by an equestrian. In other words, pants garments 40 may be configured as desired such that waistband portion 50 is positioned at or about the equestrian's waist when worn, at or about the equestrian's hips when worn, above the equestrian's natural waist when worn, below the equestrian's natural waist when worn, below the equestrian's navel when worn, and/or above the equestrian's navel when pants garment 40 is worn. Waistband portion 50 may be constructed of panels and fabrics, without any additional components or features, though in some examples waistband portion 50 optionally may include a drawstring, one or more buttons or other releasable fasteners, one or more belt loops, and/or one or more pockets. Pants garments 40 are generally constructed to be pull-on garments, such as leggings or tights and may be free from zippers, buttons, snaps, or other releasable fasteners to releasably secure the waistband portion around the equestrian's waist, though some examples of pants garments 40 may include one or more of such zippers, buttons, snaps, or other releasable fasteners.

Pants garment 40 may be formed of a plurality of textiles, or fabrics. In some examples, pants garment 40 includes different textiles, combinations of textiles, or a number of layers of textiles in different parts, or areas, of pants garment 40. For example, at least a portion of right leg portion 42 and left leg portion 44 may be at least substantially formed of a base textile, while hip abductor support panels 52, knee stabilization panels 54, calf panels 56, and/or lumbar panel 64 may include at least one layer of a mesh textile, or other stretchable material distinct from the base textile. The mesh textile of hip abductor support panels 52, knee stabilization panels 54, calf panels 56, and/or lumbar panel 64 may be provided in addition to or instead of the base textile in the areas of these panels. Said mesh textile may be overlaid onto the outer surface of the base textile, may underlie the base textile (e.g., may be positioned on an inner surface of the base textile, such that it is positioned against the skin, or facing the skin, of the equestrian's legs when pants garment 40 is worn), may be layered such that multiple layers of the mesh textile are present, and/or may be present in some areas of pants garment 40 without the base textile. In some examples, the base textile may be effectively sandwiched between an inner and outer layer of the mesh textile in areas forming hip abductor support panels 52, knee stabilization panels 54, calf panels 56, and/or lumbar panel 64. Generally, the base textile may be a first stretchable material that provides a first compressive force to the legs of the equestrian when pants garment 40 is worn, and the mesh textile may be a second stretchable material that is configured to provide a second compressive force to the legs of the equestrian when pants garment 40 is worn.

Different compressive forces may be applied to different areas of the equestrian's legs depending on the respective positioning and placement of the base textile and mesh textile in different areas of pants garment 40. For example, a plurality of layers of the base textile may be used to apply an increased compressive force as compared to areas of pants garment 40 having just a single layer, or fewer layers, of the base textile. Similarly, combining the base textile and the mesh textile (e.g., by overlaying or overlapping one over the other) may configure pants garment 40 to provide a greater compressive force to the equestrian's legs in those areas than either material does alone. In some examples, the mesh textile may be less stretchable, and/or have a greater compressive, or tightening, force than the base textile, such that the compressive force applied to the equestrian's body by the mesh textile may be greater than that applied by the base textile. In this manner, at least a portion of each of right leg portion 42 and left leg portion 44 may be configured to provide a first compressive force to the equestrian's legs when pants garment 40 is worn by the equestrian, due to the presence of the base textile. In addition, other areas of pants garment 40, such as hip abductor support panels 52, knee stabilization panels 54, and lumbar panel 64, may be configured to provide a second compressive force to respective corresponding areas of the equestrian's legs and the lumbar region of the equestrian when pants garment 40 is worn by the equestrian, due to the inclusion of the mesh textile in these panels. The second compressive force applied by the portion of pants garment 40 formed of the mesh textile (or the mesh textile combined with the base textile) is greater than the first compressive force applied by the portions of pants garment 40 formed of just the base textile.

In general terms, each of right leg portion 42 and left leg portion 44 may include a first portion 66 that is substantially formed of the base textile (without the mesh textile), a second portion 68 that is substantially formed of just the mesh textile (without the base textile), and a third portion 70 that is formed of a combination of the base textile and the mesh textile. Other examples of pants garment 40 may include first portion 66 and second portion 68 without third portion 70, second portion 68 and third portion 70 without first portion 66, or first portion 66 and third portion 70 without second portion 68. Each so-called portion 66, 68, 70 may be formed of various spaced-apart areas of pants garment 40. For example, first portion 66 may include areas of pants garment 40 corresponding to the equestrian's upper thighs, lower thighs, knees, and/or shins when pants garment 40 is worn, with some such areas being continuous with each other in some examples, and discontinuous in some examples. In some examples, second portion 68 includes calf panels 56, and/or other areas of pants garment 40. In other words, at least a portion of second portion 68 may be positioned on the equestrian's calves and/or distal to the equestrian's knees when pants garment 40 is worn. In some examples, third portion 70 may include hip abductor support panels 52, knee stabilization panels 54, calf panels 56, and/or lumbar panel 64. Second portion 68 may generally be configured to provide areas of increased breathability as compared to the base textile (e.g., as compared to first portion 66), while third portion 70 may be configured to provide areas of increased compression, or compressive force, to the equestrian's legs (e.g., muscle support and/or joint stabilization), as compared to areas of pants garment 40 formed primarily of just the base textile (e.g., as compared to first portion 66).

In some examples of pants garment 40, first portion 66, second portion 68, and/or third portion 70 may be at least substantially non-overlapping with one another. For example, second portion 68 may be at least substantially free from overlap with first portion 66, and/or third portion 70 may be at least substantially free from overlap with first portion 66 and second portion 68. In other words, first portion 66, second portion 68, and/or third portion 70 may correspond to at least substantially distinct portions of pants garment 40. For example, second portion 68 may be positioned in the calf area of pants garment 40, while first portion 66 and third portion 70 may be at least substantially absent from the calf area of pants garment 40, such that second portion 68 is at least substantially free from overlap with first portion 66 or third portion 70. It is to be understood that the nature of the constructions of garments generally will result in a small degree of overlap between the respective portions 66, 68, 70, such as due to stitching and seams that couple portions of pants garment 40 together. In other examples of pants garment 40, there may be more, or significant, overlap of first portion 66, second portion 68, and/or third portion 70 in various regions or areas of pants garment 40. In some examples, the base textile may be at least substantially continuous throughout first portion 66 and third portion 70, with third portion 70 being formed by layering the mesh textile with the base textile to differentiate first portion 66 and third portion 70. Additionally or alternatively, the mesh textile may be at least substantially continuous throughout second portion 68 and third portion 70, with third portion 70 being formed by layering the base textile with the mesh textile to differentiate second portion 68 and third portion 70.

These portions 66, 68, 70 of pants garment 40 may be described in terms of a percentage of the surface area of pants garment 40 that each covers. For example, first portion 66 may cover at least 30% of a surface area of pants garment 40, at least 40% of the surface area of pants garment 40, at least 50% of the surface area of pants garment 40, and/or at least 60% of the surface area of pants garment 40. Additionally or alternatively, second portion 68 may cover at least 5% of the surface area of pants garment 40, at least 10% of the surface area of pants garment 40, at least 15% of the surface area of pants garment 40, at least 20% of the surface area of pants garment 40, and/or at least 25% of the surface area of pants garment 40. Additionally or alternatively, third portion 70 may cover at least 10% of the surface area of pants garment 40, at least 15% of the surface area of pants garment 40, at least 20% of the surface area of pants garment 40, at least 25% of the surface area of pants garment 40, at least 30% of the surface area of pants garment 40, and/or at least 40% of the surface area of pants garment 40.

In some examples, at least a portion of hip abductor support panels 52, knee stabilization panels 54, and lumbar panel 64 are constructed of the mesh textile overlaid on the base textile. Additionally or alternatively, the mesh textile may underlie the base textile for at least a portion of hip abductor support panels 52, knee stabilization panels 54, and lumbar panel 64. In some examples, hip abductor support panels 52, knee stabilization panels 54, calf panels 56, and/or lumbar panel 64 may be formed of a different material than one or more other of hip abductor support panels 52, knee stabilization panels 54, calf panels 56, and lumbar panel 64. For example, a different mesh textile may be used for one or more of hip abductor support panels 52, knee stabilization panels 54, calf panels 56, and lumbar panel 64 than is used for one or more other of hip abductor support panels 52, knee stabilization panels 54, calf panels 56, and lumbar panel 64. In various examples of pants garment 40, hip abductor support panels 52, knee stabilization panels 54, calf panels 56, and/or lumbar panel 64 may be formed of two or more layers of materials.

In some examples, calf panels 56 are constructed of just the mesh textile, or other stretchable material, without an underlying base textile, for some or all of the surface area of calf panels 56. In other words, calf panels 56 may be formed of the mesh textile and may be devoid of the base textile from which at least a portion of each of right leg portion 42 and left leg portion 44 is formed. In this manner, calf panels 56 (which may form some or all of second portion 68) may be configured to provide increased breathability as compared to other areas of pants garment 40, such as hip abductor support panels 52, knee stabilization panels 54, and/or lumbar panel 64. In particular examples, calf panels 56 may by generally shaped and sized to be positioned inside the equestrian's boots and thus provide increased breathability in an area that may be prone to overheating.

The base textile and mesh textile, and any other fabrics or textiles used in pants garment 40 may be any suitable material, though will generally at least substantially include stretchable (e.g., elastic) materials. In some examples, the base textile may be a compression knit material, and/or the mesh textile may be a texture mesh material. In a specific example, such a texture mesh material may have a crisscross pattern or appearance, though many different appearances and textures of the mesh textile are suitable and within the scope of the present disclosure. In some examples, the mesh textile has a decorative appearance, and/or a soft hand feel. In some examples, the base textile and the mesh textile each may be a blended textile. As an illustrative example, the base textile may be a material such as a polyester/spandex (elastane) blend, while the mesh textile may be a material such as a nylon/spandex blend. In some examples, the base textile may be more stretchable than the mesh textile. For example, the base textile may have a higher percentage of spandex (or other elastic material, such as a bio-based or recycled elastane like ROICA™ or SORONA®) than that of the mesh textile. In a specific example, the base textile may have a percentage of spandex that is at least twice the percentage of spandex contained in the mesh textile. The base textile may have, for example, at least 5% spandex, at least 10% spandex, at least 15% spandex, at least 20% spandex, at least 25% spandex, at least 30% spandex, and/or at least 35% spandex. Additionally or alternatively, the mesh textile may have, for example, at least 1% spandex, at least 5% spandex, at least 10% spandex, and/or at least 15% spandex. In a specific example, the base textile has between 25-30% spandex, and the mesh textile has between 10-15% spandex. For example, a suitable base textile may be composed of about 72% polyester and 28% spandex, while a suitable mesh textile may be composed of about 87% nylon and 13% spandex, though of course these are non-limiting examples.

Suitable textiles for the base textile and/or the mesh textile may be configured to have four-way stretch, provide sun protection (e.g., having an ultraviolet protection factor (UPF) of at least 10, at least 20, at least 30, at least 40, and/or at least 50), be breathable, be moisture-wicking, be reflective, control or reduce odor, be cooling, be water-resistant, be wind-resistant, be waterproof, and/or be anti-microbial (and/or features may be added to the base textile and/or the mesh textile to impart one or more of these features to pants garment 40). The base textile and/or the mesh textile may include fibers or other material woven and/or embedded therein, such as by being infused with copper and/or silver fibers. The base textile and/or the mesh textile may be configured to radiate energy from the equestrian such that the energy is reflected back to the equestrian in the form of far infrared rays (FIR). Additionally or alternatively, the base textile and/or the mesh textile may comprise a print and/or pattern. In some examples, the appearance of the base textile and the mesh textile are visually distinct from one another (such as in color, texture, reflectiveness, and/or pattern).

Examples of pants garment 40 may include a groin region 76 that is devoid of any groin seams, which may increase comfort for the equestrian wearing pants garment 40. Additionally or alternatively, pants garment 40 may be devoid of seams along the inner/medial portions of the legs (e.g., devoid of an inseam), which also may increase equestrian comfort when pants garment 40 is worn by the equestrian. For example, pants garment 40 may include an inner panel region 78 in each of right leg portion 42 and left leg portion 44, with each inner panel region 78 being devoid of seams in some examples. Such inner panel regions 78 are generally positioned on the equestrian's inner thighs when pants garment 40 is worn by the equestrian, and may correspond to areas of the equestrian's legs that experience a significant amount of movement and/or pressure between the equestrian's inner legs and their saddle and/or horse. The presence of seams in the inner panel regions 78 can increase irritation in this area for the equestrian. These inner panel regions 78 may extend from groin region 76 inferiorly to the inner calf of the equestrian (e.g., past the equestrian's respective inner knee regions) when pants garment 40 is worn, in some examples. In some examples, the entire length of pants garment 40 is free from seams on the medial sides of the right and left leg portions 42, 44. Pants garment 40 may be constructed using flatlock stitch seams for some or all of the seams in the garment. In some examples of pants garment 40, a majority of the seams may be flatlock stitched seams, and in some examples of pants garment 40 all of the seams may even be flatlock stitched seams.

In some examples, pants garment 40 includes a silicone grip 80 configured for reducing slippage, such as between pants garment 40 and the equestrian's saddle when the pants garment is worn during horseback riding. Silicone grip 80 may be positioned, for example, within one or both of inner panel regions 78 of right leg portion 42 and left leg portion 44. In some examples, silicone grip 80 is proximal to calf panels 56 of each of right leg portion 42 and left leg portion 44, and may extend both proximal and distal to the equestrian's knees when pants garment 40 is worn.

Pants garment 40 may include one or more pockets 82 in right leg portion 42 and/or left leg portion 44. Such pockets 82 may include side pockets formed along one or both lateral sides of pants garment 40, front pockets formed on anterior side 62 of pants garment 40, and/or rear pockets formed on posterior side 60 of pants garment 40 (e.g., within lumbar panel 64). Pockets 82 may be formed of one or more additional layers of material, such as one or more additional layers of the base textile and/or mesh textile, applied to right leg portion 42, left leg portion 44, and/or waistband portion 50 to form pockets 82. Pockets 82 may be formed on an exterior portion of pants garment 40 and/or on an interior portion of pants garment 40. Pockets 82 may be smaller sized, such as to securely hold a key or card, and/or may be larger, such as to hold a mobile phone. In some examples of pants garment 40, pockets 82 may have closures, such as hook-and-loop closures, zippers, snaps, buttons, magnets, and/or overlapping layers of fabric that are configured to prevent items from falling out of the pockets 82.

FIGS. 3-9 provide examples of pants garment 40, or portions thereof. Where appropriate, elements that serve a similar, or at least substantially similar, purpose as described in connection with FIG. 2 are labeled with like numbers in each of FIGS. 3-9, and these elements may not be discussed in detail herein with reference to each of FIGS. 3-9. Similarly, all elements may not be labeled in each of FIGS. 3-9, but reference numerals associated therewith may be utilized herein for consistency. Elements, components, and/or features that are discussed herein with reference to one or more of FIGS. 3-9 may be included in and/or utilized with any of FIGS. 3-9 without departing from the scope of the present disclosure. However, the examples of FIGS. 3-9 are non-exclusive and do not limit pants garments 40 to the illustrated embodiments. That is, pants garments 40 are not limited to the specific embodiments illustrated in FIGS. 3-9, and may incorporate any number of the various aspects, configurations, characteristics, properties, etc. that are illustrated in and discussed with reference to the schematic representation of FIG. 2 and/or the examples of FIGS. 3-9, as well as variations thereof, without requiring the inclusion of all such aspects, configurations, characteristics, properties, etc.

Figure 4:
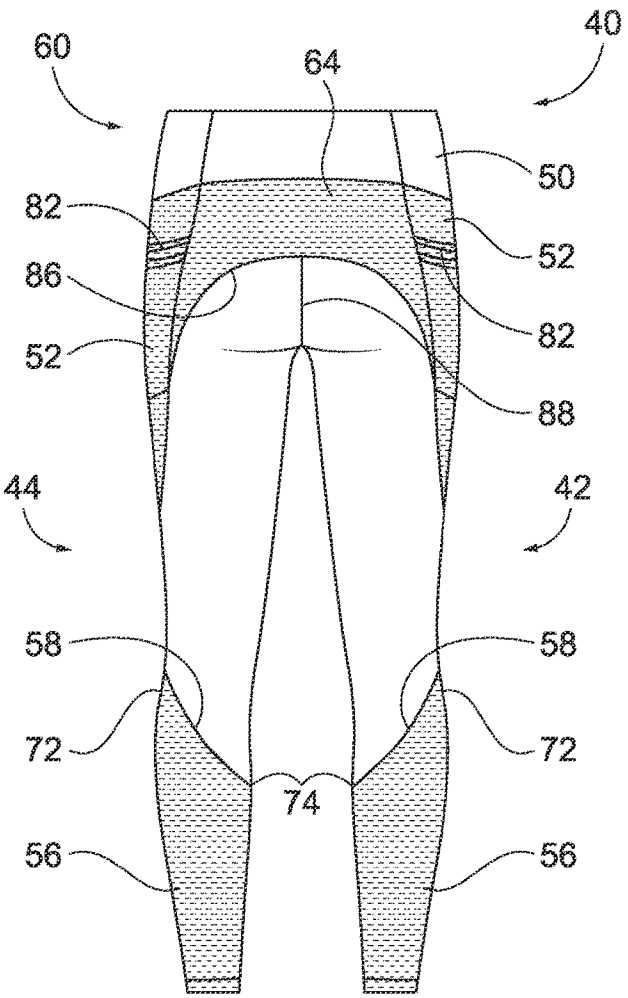
FIG. 4 is a back elevation view of the example of a pants garment of FIG. 3.
Figure 3:
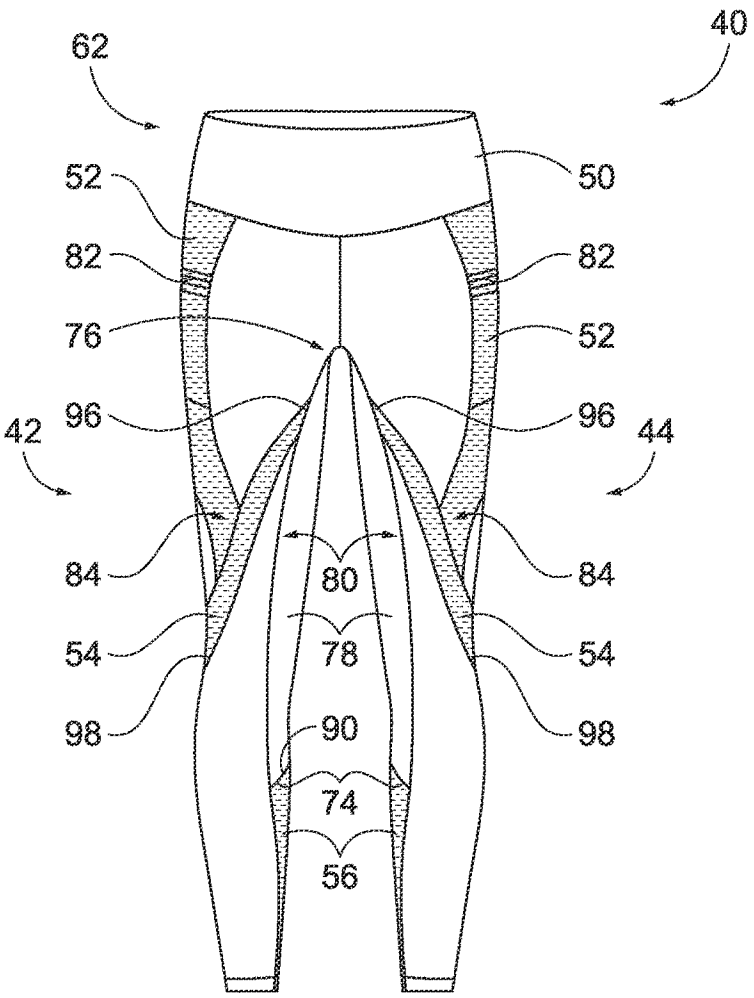
FIG. 3 is a front elevation view of an example of a pants garment according to the present disclosure.
Figure 5:
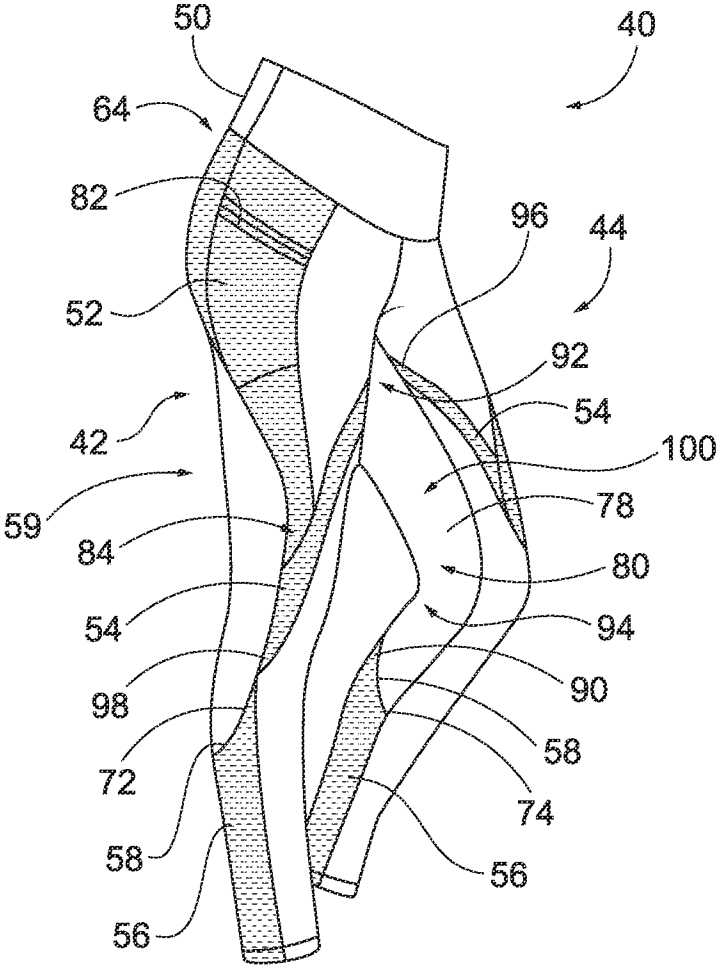
FIG. 5 is a side perspective view of the example of a pants garment of FIG. 3.

FIGS. 3-5 illustrate an example of pants garment 40, showing anterior side 62 of pants garment 40 in FIG. 3, posterior side 60 of pants garment 40 in FIG. 4, and a side perspective view of pants garment 40 in FIG. 5. Hip abductor support panels 52, knee stabilization panels 54, lumbar panel 64, and calf panels 56 are configured for body-mapped zoning compression, and are configured to provide targeted support for muscle groups prone to injury and fatigue by equestrian riders.

As best seen in FIG. 4, each calf panel 56 in this example has a respective proximal edge region 58 that extends inferiorly and obliquely from its respective lateral side 72 to its respective medial side 74 of each proximal edge region 58. Each calf panel 56 may meet a respective knee stabilization panel 54 at a respective outer knee area of the equestrian when pants garment 40 is worn by the equestrian—this is best seen on right leg portion 42 in FIG. 5, wherein calf panel 56 meets knee stabilization panel 54 at lateral side 72 of proximal edge region 58 of calf panel 56.

In some examples, and as best seen in FIGS. 3 and 5, hip abductor support panels 52 may extend inferiorly from waistband portion 50, to a distal end region 84 of each respective hip abductor support panel 52, which meets the respective knee stabilization panel 54 of the same leg portion 42, 44. For example, distal end region 84 of hip abductor support panel 52 of right leg portion 42 meets knee stabilization panel 54 of right leg portion 42, and distal end region 84 of hip abductor support panel 52 of left leg portion 44 meets knee stabilization panel 54 of left leg portion 44. Distal end region 84 of each hip abductor support panel 52 may meet a respective knee stabilization panel 54 in a respective area of pants garment 40 corresponding to the equestrian's outer knee, outer thigh, and/or the front lateral side of the equestrian's thigh, though the two support panels 52, 54 are generally wrapped and extending across the equestrian's legs so as to avoid passing through, or wrapping around, the inner knee area of the equestrian. In this manner, inner panel regions 78 may be at least substantially seam-free and devoid of any support panels 52, 54, 56.

Each knee stabilization panel 54 may extend obliquely from the equestrian's upper thigh to the equestrian's outer knee area, as best illustrated in FIG. 3. In some examples and as best seen in FIG. 5, each knee stabilization panel 54 may extend superiorly and obliquely from a respective calf panel 56 (which may correspond to second portion 68 of pants garment 40) to a respective inner panel region 78 of each of right leg portion 42 and left leg portion 44 (which is best seen in the view of FIG. 3, where respective superior end regions 96 of each knee stabilization panel 54 meet a respective inner panel region 78). A respective inferior end region 98 of each knee stabilization panel 54 may meet a respective calf panel 56 on the equestrian's outer legs, as best seen in FIG. 5. Distal end region 84 of each hip abductor support panel 52 may meet a respective knee stabilization panel 54 (e.g., near to or within inferior end region 98 of knee stabilization panel 54), as seen in FIGS. 3 and 5. Each knee stabilization panel 54 may be configured to provide support and/or reduce fatigue for the equestrian's thigh muscles when pants garment 40 is worn. Similarly, each hip abductor support panel 52 may be contoured to generally approximate the equestrian's hip abductor muscle group.

As best seen in FIG. 4, lumbar panel 64 may extend along waistband portion 50, on posterior side 60 of pants garment 40. Lumbar panel 64 may include a concave down curve 86 and may extend laterally in both directions away from a centerline of pants garment 40, such that it interfaces with respective hip abductor support panels 52 of each of right leg portion 42 and left leg portion 44. Lumbar panel 64 may be positioned to extend across and/or provide support to the equestrian's sacrum, lower spinal cord, lower back/lumbar region, pelvic region, and/or upper glute region of the equestrian when pants garment 40 is worn. As shown, lumbar panel 64 may extend laterally away in both directions from a medial interface region 88 where right leg portion 42 meets, or interfaces with, left leg portion 44 on posterior side 60 of pants garment 40. Lumbar panel 64 may be configured to support the equestrian's lumbar and/or pelvic region, areas which may be under stress in common riding positions, such as the two-point position.

The example of pants garment 40 of FIGS. 3-6 includes inner panel regions 78 on both right leg portion 42 and left leg portion 44. Said inner panel regions 78 may extend to a respective interface 90 with calf panels 56 (which may correspond to second portion 68 of pants garment 40, as described above), as best seen in FIG. 5. Said interfaces 90 may be distal to the equestrian's knee when pants garment 40 is worn, such that inner panel regions 78 extend above and below the equestrian's knees. In the example shown, inner panel regions 78 extend inferiorly along each of right leg portion 42 and left leg portion 44, from groin region 76 of pants garment 40, and continue past (e.g., distal to) the equestrian's knees when pants garment 40 is worn, as noted. In some examples, inner panel regions 78 extend from the equestrian's inner knee/thigh region to the back of the equestrian's legs, corresponding to posterior side 60 of pants garment 40. Pants garment 40 also includes silicone grip 80 on inner panel regions 78 in this example, with said silicone grip 80 extending inferiorly from an upper area 92 of silicone grip 80 that is proximal to the equestrian's knees when pants garment 40 is worn, to a lower area 94 of silicone grip 80 that is distal to the equestrian's knees when pants garment 40 is worn.

Figure 6:
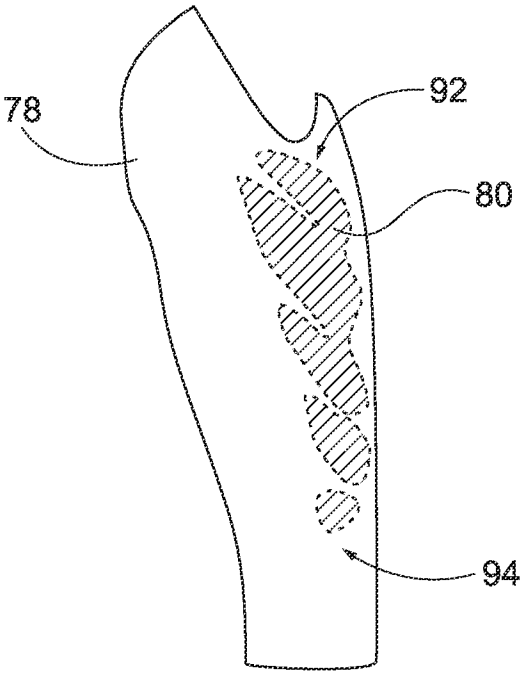
FIG. 6 is a side elevation view of an example of a portion of a pants garment according to the present disclosure.

FIG. 6 shows an example of inner panel region 78, illustrating an example of the extent to which silicone grip 80 may be present in inner panel region 78, extending from upper area 92 of grip 80 to lower area 94 of grip 80. In some examples, silicone grip 80 may be a flexible, low-profile design, and/or configured to handle high heat and friction conditions. Silicone grip 80 may be at least substantially or completely formed from silicone rubber in some examples, though in other examples, different materials and combinations of materials (even excluding silicone) may be used for silicone grip 80. In some examples, silicone grip 80 may be configured to engage with a corresponding grip inside the equestrian's riding boots.

Figure 7:
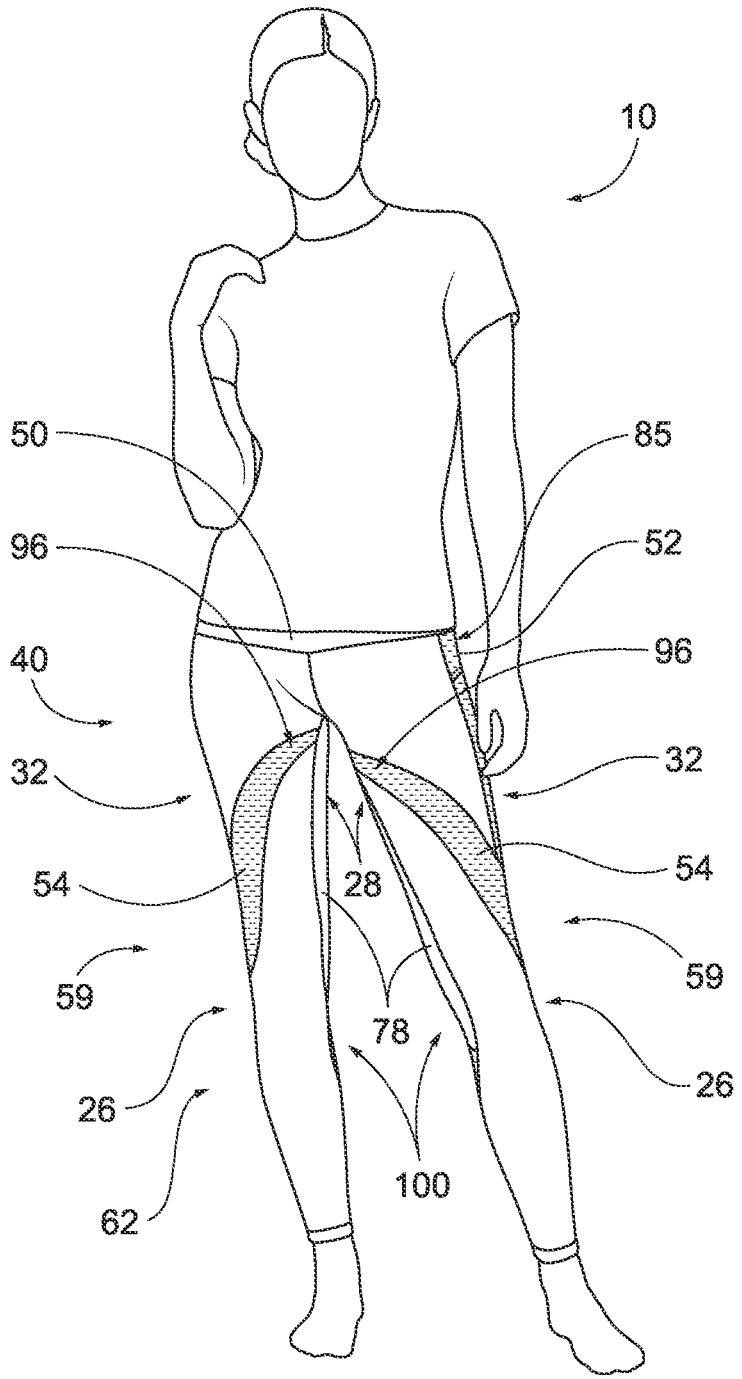
FIG. 7 is a front elevation view of an example of a pants garment according to the present disclosure, shown being worn by an equestrian.
Figure 8:
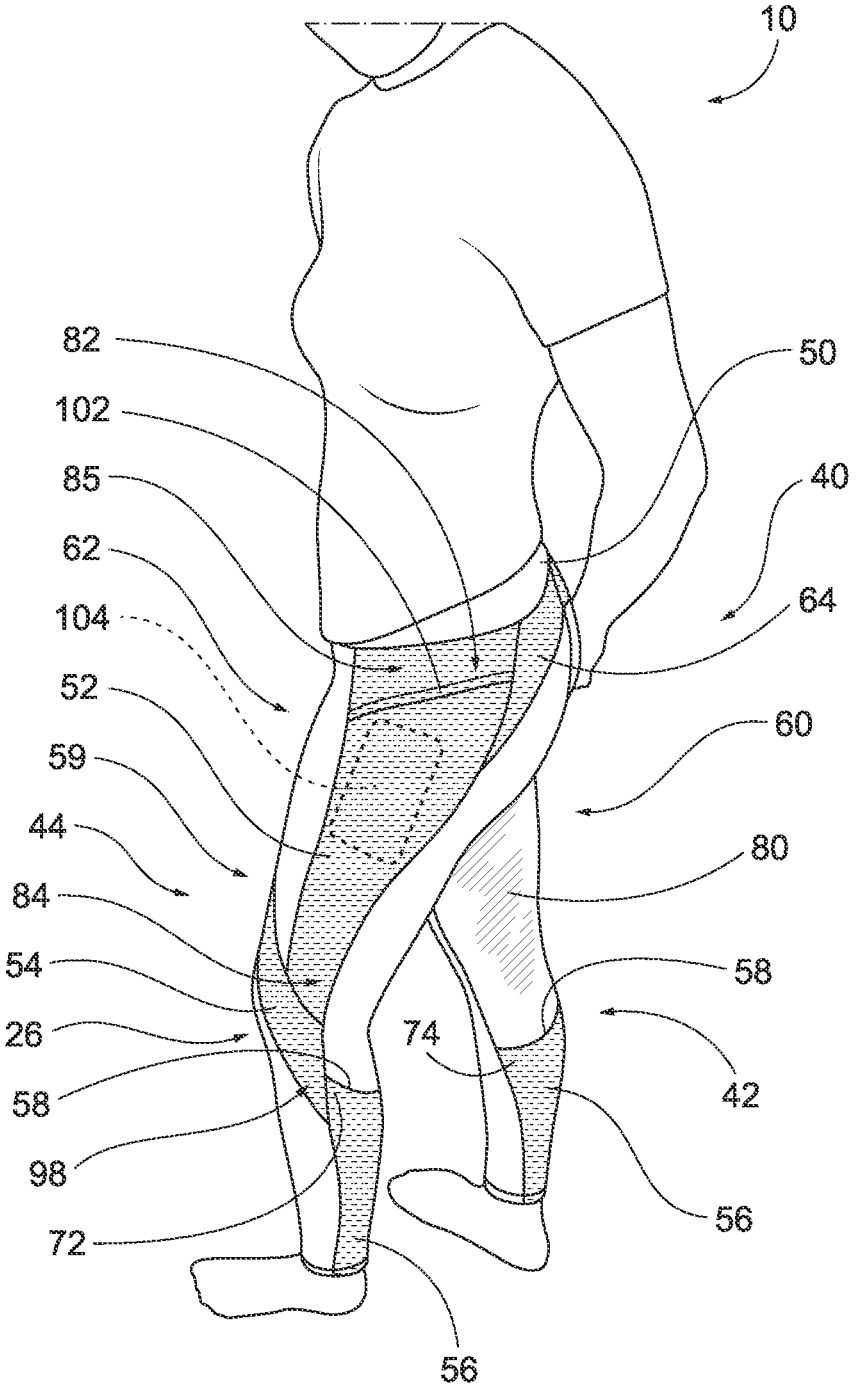
FIG. 8 is a side perspective view of the example of a pants garment of FIG. 7, shown with a mobile device contained within a pocket of the pants garment.
Figure 9:
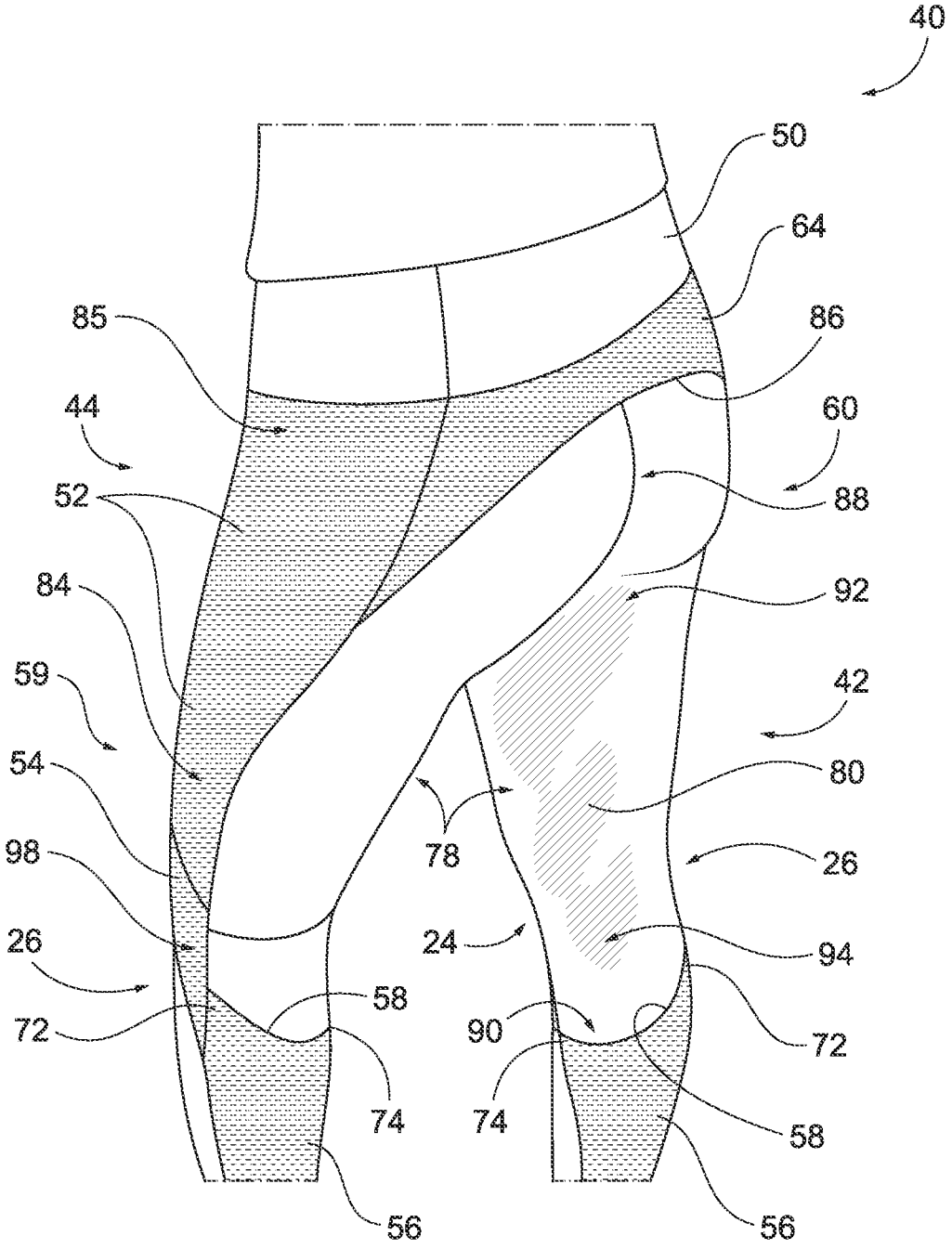
FIG. 9 is a back perspective view of the example of a pants garment of FIG. 7, shown being worn by an equestrian.

FIGS. 7-9 illustrate an example of pants garment 40 worn by an equestrian, which further illustrates an example of placement of hip abductor support panels 52, knee stabilization panels 54, calf panels 56, and lumbar panel 64 with respect to the equestrian's legs and torso. FIG. 7 illustrates an example of pants garment 40 viewed from the front, or anterior side 62 of pants garment 40, FIG. 8 illustrates an example of pants garment 40 viewed laterally, from the side, and FIG. 9 illustrates an example of pants garment 40 viewed from the back, or posterior side 60 of pants garment 40. As with other examples disclosed herein, hip abductor support panels 52, knee stabilization panels 54, lumbar panel 64, and calf panels 56 are configured for body-mapped zoning compression, and are configured to provide targeted support for muscle groups prone to injury and fatigue by equestrian riders.

As best seen in FIGS. 8-9, each calf panel 56 in this example has a respective proximal edge region 58 that extends inferiorly and obliquely from its respective lateral side 72 to its respective medial side 74 of each proximal edge region 58. Each respective calf panel 56 meets a respective knee stabilization panel 54 at a respective outer knee area 26 of the equestrian when pants garment 40 is worn by the equestrian—this is best seen on left leg portion 44 in FIGS. 8-9, wherein calf panel 56 meets knee stabilization panel 54 at lateral side 72 of proximal edge region 58 of calf panel 56.

Also as best seen in FIGS. 8-9, in this example, hip abductor support panels 52 extend inferiorly from waistband portion 50, to a respective distal end region 84 of each respective hip abductor support panel 52, which meets the respective knee stabilization panel 54 of the same respective leg portion 42, 44. For example, distal end region 84 of hip abductor support panel 52 of left leg portion 44 meets knee stabilization panel 54 of left leg portion 44, and distal end region 84 of hip abductor support panel 52 of right leg portion 42 meets knee stabilization panel 54 of right leg portion 42. When worn by an equestrian, pants garment 40 may be configured such that distal end region 84 of each respective hip abductor support panel 52 meets a respective knee stabilization panel 54 in a respective area of pants garment 40 corresponding to the equestrian's outer knee 26, or an area of the outer thigh just superior to outer knee 26. As seen in all of FIGS. 7-9, knee stabilization panels 54 are positioned to extend from the equestrian's upper inner thigh area 28 and traverse laterally and inferiorly across the equestrian's thigh 32 to the equestrian's outer knee area 26, so as to avoid passing through, or wrapping around, the inner knee area 24 of the equestrian (see FIG. 1). In this manner, inner panel regions 78 may be at least substantially seam-free and devoid of any support panels 52, 54, 56, as best seen in FIGS. 8-9.

As best seen in FIG. 8, each respective knee stabilization panel 54 may meet a respective hip abductor support panel 52 and a respective calf panel 56 within a respective lateral region 59 of pants garment 40. Each respective knee stabilization panel 54 extends superiorly and obliquely from a respective calf panel 56 at or near the outer knee area 26 to a respective inner panel region 78 of each of right leg portion 42 and left leg portion 44 on a respective medial region 100 of each leg portion 42, 44. Each knee stabilization panel 54 may meet a respective calf panel 56 at a respective inferior end region 98 of the knee stabilization panel 54 on a respective lateral region 59 of each leg portion 42, 44, while a respective superior end region 96 (FIG. 7) of each knee stabilization panel 54 may be positioned within a medial region 100 of each leg portion 42, 44, corresponding to the equestrian's upper inner thigh 28, as noted above. Additionally or alternatively, distal end region 84 of each hip abductor support panel 52 may meet a respective knee stabilization panel 54 (e.g., near to or within inferior end region 98 of knee stabilization panel 54), while a proximal end region 85 of each hip abductor support panel 52 may meet waistband portion 50 and/or lumbar panel 64, as best seen in FIGS. 8-9. Hip abductor support panels 52 may be contoured or curved to follow approximate lines of the equestrian's tendons and ligaments underlying the hip abductor support panels 52. Additionally or alternatively, hip abductor support panels 52 may vary in width along the length of each respective hip abductor support panel 52. For example, as best seen in FIG. 8, each respective hip abductor support panel 52 may be narrower in width at its distal end region 84 (e.g., where it meets a respective knee stabilization panel 54 at the equestrian's outer knee 26), while each respective hip abductor support panel 52 may be wider in width at proximal end region 85 (e.g., where it meets waistband portion 50). The contours of hip abductor support panels 52 may be configured such that hip abductor support panels 52 may be predominately positioned on lateral regions 59 of pants garment 40, and may extend posteriorly more than anteriorly. To this end, hip abductor support panels 52 may be more visible when viewing the side or back of pants garment 40 (as seen in FIGS. 8-9) than when viewing the front of pants garment 40 (e.g., FIG. 7). Though it is to be understood that different sizes of pants garment 40 may fit different equestrians' bodies differently, and thus in some examples, hip abductor support panels 52 may be more visible on the front side of pants garment 40 than in other examples, depending on the respective proportions of the particular pants garment 40 and the particular proportions of the equestrian wearing them.

As best seen in FIG. 9, lumbar panel 64 may extend along waistband portion 50, on posterior side 60 of pants garment 40. Lumbar panel 64 may include a concave down curve 86 and may extend laterally in both directions away from a centerline of pants garment 40, such that it interfaces with respective hip abductor support panels 52 of each of right leg portion 42 and left leg portion 44. Lumbar panel 64 may be positioned to extend across and/or provide support to the equestrian's sacrum, lower spinal cord, lower back/lumbar region, pelvic region, and/or upper glute region of the equestrian when pants garment 40 is worn. As shown, lumbar panel 64 may extend laterally away in both directions from a medial interface region 88 where right leg portion 42 meets, or interfaces with, left leg portion 44 on posterior side 60 of pants garment 40. Lumbar panel 64 may be configured to support the equestrian's lumbar and/or pelvic region, areas which may be under stress in common riding positions, such as the two-point position. In some examples, lumbar panel 64 may extend within, or overlap with, waistband portion 50 such that at least a portion of waistband portion 50 may be configured to provide additional compressive forces to the equestrian's body while pants garment 40 is worn, along with lumbar panel 64.

The example of pants garment 40 of FIGS. 7-9 includes inner panel regions 78 on both right leg portion 42 and left leg portion 44 (best seen in FIGS. 8-9). Said inner panel regions 78 may extend to a respective interface 90 with calf panels 56 and thus may be distal to the equestrian's knee when pants garment 40 is worn, such that inner panel regions 78 extend above and below the equestrian's knees. Pants garment 40 also optionally includes silicone grip 80 on at least a portion of inner panel regions 78 in this example, with said silicone grip 80 extending inferiorly from an upper area 92 of silicone grip 80 that is proximal to the equestrian's knees when pants garment 40 is worn, to a lower area 94 of silicone grip 80. Lower area 94 of silicone grip 80 may be distal to the equestrian's knees when pants garment 40 is worn, though in some examples lower area 94 of silicone grip 80 may be within the equestrian's knee region, or may terminate superior to the equestrian's knees.

As best seen in FIG. 8, pants garment 40 may include a pocket 82 formed in one or both hip abductor support panels 52. In the example of FIG. 8, pocket 82 is shown in hip abductor support panel 52 on left leg portion 44, and is formed between an outer mesh textile and one or more interior layers of material inside hip abductor support panel 52. An overlapping panel 102 is formed at the superior/open end of pocket 82 to form a closure for pocket 82. For example, overlapping panel 102 overlaps the superior/open end of pocket 82 to cover it and is configured to prevent items from accidentally falling out of pocket 82. In the example of FIG. 8, a mobile phone 104 is indicated in dashed lines, representing mobile phone 104 being contained within pocket 82, though in various examples of pants garment 40, pocket or pockets 82 may be smaller and/or in other locations of pants garment 40. For example, additionally or alternatively to pocket 82 or hip abductor support panel 52, one or more pockets 82 may be positioned within lumbar panel 64, waistband portion 50, and/or calf panels 56, in various examples of pants garment 40.

In the pants garment 40 of FIGS. 7-9, hip abductor support panels 52, knee stabilization panels 54, calf panels 56, and lumbar panel 64 apply a higher compressive force to the equestrian's body than do other areas of pants garment 40. For example, as indicated in white/unshaded areas in FIGS. 7-9, areas of anterior side 62 of pants garment 40 that are superior and inferior to knee stabilization panels 54 are formed of a base textile, as are areas of posterior side 60 of pants garment 40 that are inferior to lumbar panel 64 and superior to calf panels 56. On the other hand, knee stabilization panels 54, hip abductor support panels 52, lumbar panel 64, and calf panels 56 all include a mesh textile with less elasticity than the base textile, with said mesh textile being indicated in FIGS. 7-9 by stippling. In the example of pants garment 40 in FIGS. 7-9, the mesh textile is shown on an outer, or exterior surface of pants garment 40. Additionally or alternatively, the mesh textile may be present in these areas (e.g., knee stabilization panels 54, hip abductor support panels 52, lumbar panel 64, and calf panels 56) on an inner, or interior, surface of pants garment 40 (e.g., the mesh textile may underlie a layer of the base textile). In some examples, the mesh textile in these more compressive and supportive areas of pants garment 40 may be included between layers of the base textile, and/or a plurality of layers of the mesh textile may be present in these sections. In yet other examples, knee stabilization panels 54, hip abductor support panels 52, lumbar panel 64, and calf panels 56 may include one or more layers of the mesh textile without any layers of the base textile present in those sections of pants garment 40.

In some examples, the mesh textile of the knee stabilization panels 54, hip abductor support panels 52, lumbar panel 64, and/or calf panels 56 may not be visible when viewing pants garment 40 as it would be typically worn, though in many examples, these areas of increased support are visible to both the equestrian wearing pants garment 40 and others. Furthermore, the knee stabilization panels 54, hip abductor support panels 52, lumbar panel 64, and calf panels 56 may be configured to feel perceptibly tighter to the equestrian wearing pants garment 40, such that the increased compressive force applied by these portions of pants garment 40 may be felt and recognized by the wearer, in addition to supporting the wearer's muscles and ligaments in these areas.

The mesh textile used in knee stabilization panels 54, hip abductor support panels 52, lumbar panel 64, and/or calf panels 56 is generally more compressive and less elastic than the base textile forming other portions of pants garment 40. For example, as noted above, the base textile may have, for example, at least 5% spandex, at least 10% spandex, at least 15% spandex, at least 20% spandex, at least 25% spandex, at least 30% spandex, and/or at least 35% spandex. Additionally or alternatively, the mesh textile may have, for example, at least 1% spandex, at least 5% spandex, at least 10% spandex, and/or at least 15% spandex. In a specific example, the base textile has between 25-30% spandex, and the mesh textile has between 10-15% spandex. Viewed another way, the mesh textile may have a lower degree, or percentage, of elasticity than does the base textile, such that the base textile is more stretchable than the mesh textile. For example, the base textile may have a percentage of elasticity of at least 30%, at least 40%, at least 50%, at least 60%, at least 70%, at least 80%, at least 90%, and/or at least 100%, whereas the mesh textile may have a percentage of elasticity of less than 75%, less than 50%, and/or less than 25%.

In some examples, the effective compressive forces of pants garment 40 may be measured in millimeters of mercury (mmHg), with the areas of pants garment 40 just having the base textile having a lower compressive force than the areas including the mesh textile (e.g., knee stabilization panels 54, hip abductor support panels 52, lumbar panel 64, and calf panels 56). In some examples, all of the supportive areas of pants garment 40 may provide at least substantially the same compressive force, whereas in other examples, one or more of knee stabilization panels 54, hip abductor support panels 52, lumbar panel 64, and/or calf panels 56 may provide a different level of compression than one or more other of knee stabilization panels 54, hip abductor support panels 52, lumbar panel 64, and/or calf panels 56. For example, calf panels 56 may provide a lower level of compression than hip abductor support panels 52 and knee stabilization panels 54, in some examples. In some specific examples, knee stabilization panels 54, hip abductor support panels 52, lumbar panel 64, and/or calf panels 56 may be formed of layers of mesh textiles and/or base textiles sufficient to provide at least 5 mmHg, at least 10 mmHg, at least 15 mmHg, at least 20 mmHg, at least 25 mmHg, at least 30 mmHg, at least 35 mmHg, at least 40 mmHg, at least 45 mmHg, and/or at least 50 mmHg of compression in their respective areas. In some examples, knee stabilization panels 54, hip abductor support panels 52, lumbar panel 64, and/or calf panels 56 may have graduated compression, with varying levels of compression along the length of the respective compressive panels. On the other hand, the base textile forming other portions of left leg portion 44 and right leg portion 42 is configured to provide a lower level of compression than knee stabilization panels 54, hip abductor support panels 52, lumbar panel 64, and/or calf panels 56. In some specific examples, the base textile may be configured to provide less than 20 mmHg, less than 15 mmHg, less than 10 mmHg, and/or less than 5 mmHg of compression in the areas comprising just the base textile.

Pants garments 40 may be formed, or manufactured, using any suitable process or method that results in the pants garments 40 disclosed herein. Examples of methods of forming pants garments 40 according to the present disclosure are also disclosed. Methods of forming a pants garment 40 generally include forming a right leg portion and a left leg portion from a base textile having a first compressive force, forming a respective hip abductor support panel in each of the right leg portion and the left leg portion, forming a respective knee stabilization panel in each of the right leg portion and the left leg portion, forming a respective calf panel in each of the right leg portion and the left leg portion, and forming a lumbar panel positioned on the posterior side of the pants garment. The hip abductor support panels, the knee stabilization panels, the calf panels, and the lumbar panel are formed using a mesh textile having a second compressive force that is greater than the first compressive force of the base textile. In forming the hip abductor support panels, the knee stabilization panels, the calf panels, and/or the lumbar panel, the mesh textile may be overlaid onto the base textile in the respective areas, and/or the mesh textile may be positioned interiorly to the base textile such that the mesh textile underlies the base textile. In some methods, when forming the hip abductor support panels, the knee stabilization panels, the calf panels, and/or the lumbar panel, one or more layers of the mesh textile may be used. In some methods, forming the hip abductor support panels, the knee stabilization panels, the calf panels, and/or the lumbar panel may be performed using just the mesh textile, without the base textile present in those respective areas. In some methods, forming the hip abductor support panels, the knee stabilization panels, the calf panels, and/or the lumbar panel includes sandwiching the base textile between inner and outer layers of the mesh textile. In methods where forming the hip abductor support panels, the knee stabilization panels, the calf panels, and/or the lumbar panel includes combining the mesh textile and the base textile together and/or layering one or more layers of the mesh textile and/or one or more layers of the base textile, the textiles may be stitched together along seams defining the areas corresponding to the respective hip abductor support panels, the knee stabilization panels, the calf panels, and/or the lumbar panel.

Methods according to the present disclosure also may include forming one or more features in the pants garment as described herein, such as forming one or more pockets in one or more of the hip abductor support panels, the calf panels, the lumbar panel, the waistband portion, and/or the knee stabilization panels, and/or applying a silicone grip within an inner panel region of each of the right leg portion and the left leg portion of the pants garment.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, "at least substantially," when modifying a degree or relationship, may include not only the recited "substantial" degree or relationship, but also the full extent of the recited degree or relationship. A substantial amount of a recited degree or relationship may include at least 75% of the recited degree or relationship. For example, an object that is at least substantially formed from a material includes objects for which at least 75% of the objects are formed from the material and also includes objects that are completely formed from the material. As another example, a first length that is at least substantially as long as a second length includes first lengths that are within 75% of the second length and also includes first lengths that are as long as the second length.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

Examples of equestrian pants garments and methods of forming such garments according to the present disclosure are described in the following enumerated paragraphs:

A1. A pants garment configured to be worn by an equestrian, the pants garment comprising:

a right leg portion and a left leg portion, and wherein each of the right leg portion and the left leg portion comprises:

a hip abductor support panel that extends inferiorly from a waistband portion of the pants garment, wherein the hip abductor support panel is configured to provide compression and support to at least a portion of the equestrian's hip abductor muscle group when the pants garment is worn by the equestrian;

a knee stabilization panel that extends inferiorly from an inner thigh of the equestrian to an outer knee area of the equestrian when the pants garment is worn by the equestrian, wherein each knee stabilization panel is configured to provide compression and support to a respective knee joint and quadriceps muscle of the equestrian when the pants garment is worn by the equestrian; and a calf panel extending superiorly from a distal end region of each of the right leg portion and the left leg portion, wherein each calf panel is configured to provide compression and support to a respective calf muscle of the equestrian when the pants garment is worn by the equestrian; and a lumbar panel positioned on a posterior side of the pants garment, wherein the lumbar panel extends laterally across both the right leg portion and the left leg portion, such that the lumbar panel is configured to provide compression and support to a lumbar region of the equestrian when the pants garment is worn by the equestrian.

A1.1. The pants garment of paragraph A1, wherein the knee stabilization panel extends inferiorly and obliquely from an inner thigh of the equestrian to an outer knee area of the equestrian.

A2. The pants garment of paragraph A1 or A1.1, wherein the hip abductor support panels, the knee stabilization panels, the calf panels, and/or the lumbar panel are overlaid onto a base textile from which at least a portion of each of the right leg portion and the left leg portion is formed.

A3. The pants garment of any of paragraphs A1-A2, wherein the hip abductor support panels, the knee stabilization panels, the calf panels, and/or the lumbar panel underlie a/the base textile from which at least a portion of each of the right leg portion and the left leg portion is formed.

A4. The pants garment of any of paragraphs A1-A3, wherein one or more of the hip abductor support panels, the knee stabilization panels, the calf panels, and/or the lumbar panel comprises a different material than one or more other of the hip abductor support panels, the knee stabilization panels, the calf panels, and the lumbar panel.

A5. The pants garment of any of paragraphs A1-A4, wherein the hip abductor support panels, the knee stabilization panels, the calf panels, and/or the lumbar panel comprise a different material than a/the base textile from which at least a portion of each of the right leg portion and the left leg portion is formed.

A6. The pants garment of any of paragraphs A1-A5, wherein the hip abductor support panels, the knee stabilization panels, the calf panels, and/or the lumbar panel comprise a plurality of layers of material.

A7. The pants garment of any of paragraphs A1-A6, wherein the hip abductor support panels, the knee stabilization panels, the calf panels, and/or the lumbar panel comprise a mesh textile.

A8. The pants garment of paragraph A7, wherein a/the base textile from which at least a portion of each of the right leg portion and the left leg portion is formed comprises a first stretchable material, and wherein the mesh textile comprises a second stretchable material.

A9. The pants garment of any of paragraphs A1-A8, wherein each calf panel is positioned on the posterior side of the pants garment.

A10. The pants garment of any of paragraphs A1-A9, wherein each calf panel comprises a proximal edge region that extends inferiorly and obliquely from a respective lateral side to a respective medial side of each proximal edge region.

A11. The pants garment of any of paragraphs A1-A10, wherein each calf panel meets a respective knee stabilization panel at a respective outer knee area of the equestrian when the pants garment is worn by the equestrian.

A12. The pants garment of any of paragraphs A1-A11, wherein a distal end region of the hip abductor support panel of the right leg portion meets the knee stabilization panel of the right leg portion, and wherein a distal end region of the hip abductor support panel of the left leg portion meets the knee stabilization panel of the left leg portion.

A13. The pants garment of any of paragraphs A1-A12, wherein the lumbar panel extends along the waistband portion of the pants garment, on the posterior side of the pants garment.

A14. The pants garment of any of paragraphs A1-A13, wherein the pants garment comprises a medial interface region where the right leg portion interfaces with the left leg portion on the posterior side of the pants garment, and wherein the lumbar panel extends laterally away from the medial interface region to both the hip abductor support panel of the left leg portion and the hip abductor support panel of the right leg portion.

A15. The pants garment of any of paragraphs A1-A14, wherein the calf panels are configured to provide increased breathability as compared to the hip abductor support panels, the knee stabilization panels, and the lumbar panel.

A16. The pants garment of any of paragraphs A1-A15, wherein the calf panels comprise a/the mesh textile and are devoid of a/the base textile from which at least a portion of each of the right leg portion and the left leg portion is formed.

A17. The pants garment of any of paragraphs A1-A16, wherein a/the base textile from which at least a portion of each of the right leg portion and the left leg portion is formed is configured to provide a first compressive force to the equestrian's legs when the pants garment is worn by the equestrian, wherein the hip abductor support panels, the knee stabilization panels, and the lumbar panel are configured to provide a second compressive force to respective areas of the equestrian's legs and lumbar region of the equestrian when the pants garment is worn by the equestrian, and wherein the second compressive force is greater than the first compressive force.

A17.1. The pants garment of paragraph A17, wherein the knee stabilization panels, the hip abductor support panels, the lumbar panel, and/or the calf panels are configured to provide at least 5 mmHg, at least 10 mmHg, at least 15 mmHg, at least 20 mmHg, at least 25 mmHg, at least 30 mmHg, at least 35 mmHg, at least 40 mmHg, at least 45 mmHg, and/or at least 50 mmHg of compression in their respective areas.

A17.2. The pants garment of paragraph A17 or A17.1, wherein the base textile is configured to provide less than 20 mmHg, less than 15 mmHg, less than 10 mmHg, and/or less than 5 mmHg of compression.

A17.3. The pants garment of any of paragraphs A17-A17.2, wherein the base textile has a higher percentage of elasticity than a/the mesh textile.

A17.4. The pants garment of any of paragraphs A17-A17.3, wherein the base textile has a percentage of elasticity of at least 30%, at least 40%, at least 50%, at least 60%, at least 70%, at least 80%, at least 90%, and/or at least 100%.

A17.5. The pants garment of any of paragraphs A17-A17.4, wherein a/the mesh textile has a percentage of elasticity of less than 75%, less than 50%, and/or less than 25%.

A18. The pants garment of any of paragraphs A1-A17.5, wherein the pants garment is devoid of a groin seam in the groin region of the pants garment.

A19. The pants garment of any of paragraphs A1-A18, wherein the pants garment is devoid of an inseam.

A20. The pants garment of any of paragraphs A1-A19, wherein a/the base textile from which at least a portion of the right leg portion and the left leg portion is formed comprises a compression knit material.

A21. The pants garment of any of paragraphs A1-A20, wherein at least a portion of the right leg portion and the left leg portion comprises a/the base textile, and wherein the hip abductor support panels, the knee stabilization panels, the lumbar panel, and/or the calf panels comprise a/the mesh textile.

A22. The pants garment of paragraph A21, wherein the base textile comprises a first percentage of spandex, wherein the mesh textile comprises a second percentage of spandex, and wherein the first percentage is greater than the second percentage.

A23. The pants garment of any of paragraphs A21-A22, wherein the base textile comprises a/the first percentage of spandex, wherein the mesh textile comprises a/the second percentage of spandex, and wherein the first percentage is at least twice the second percentage.

A24. The pants garment of any of paragraphs A21-A23, wherein the base textile comprises a polyester/spandex blend.

A25. The pants garment of any of paragraphs A21-A24, wherein the base textile comprises at least 5% spandex, at least 10% spandex, at least 15% spandex, at least 20% spandex, at least 25% spandex, at least 30% spandex, and/or at least 35% spandex.

A26. The pants garment of any of paragraphs A21-A25, wherein the mesh textile comprises a nylon/spandex blend.

A27. The pants garment of any of paragraphs A21-A26, wherein the mesh textile comprises at least 1% spandex, at least 5% spandex, at least 10% spandex, and/or at least 15% spandex.

A28. The pants garment of any of paragraphs A21-A27, wherein the base textile comprises between 25-30% spandex, and wherein the mesh textile comprises between 10-15% spandex.

A29. The pants garment of any of paragraphs A21-A28, wherein the base textile comprises a four-way stretch material.

A30. The pants garment of any of paragraphs A21-A29, wherein the base textile has an ultraviolet protection factor (UPF) of at least 10, at least 20, at least 30, at least 40, and/or at least 50.

A31. The pants garment of any of paragraphs A21-A30, wherein the base textile is breathable, moisture-wicking, odor-controlling, cooling, and/or anti-microbial.

A32. The pants garment of any of paragraphs A21-A31, wherein the base textile is infused with copper fibers.

A33. The pants garment of any of paragraphs A21-A32, wherein the base textile is configured to radiate energy from the equestrian such that the energy is reflected back to the equestrian in the form of far infrared rays (FIR).

A34. The pants garment of any of paragraphs A1-A33, further comprising at least one pocket formed from an additional layer of a/the mesh textile.

A34.1. The pants garment of paragraph A34, wherein the at least one pocket is formed in the hip abductor support panel of the right leg portion and/or the hip abductor support panel of the left leg portion.

A35. The pants garment of any of paragraphs A1-A34.1, further comprising a silicone grip configured for reducing slippage between the pants garment and the equestrian's saddle when the pants garment is worn during horseback riding.

A36. The pants garment of paragraph A35, wherein the silicone grip is positioned within an inner panel region of each of the right leg portion and the left leg portion of the pants garment.

A37. The pants garment of paragraph A35 or A36, wherein the silicone grip extends inferiorly from an upper area proximal to each of the equestrian's knees when the pants garment is worn, to a lower area.

A37.1. The pants garment of paragraph A37, wherein the lower area of the silicone grip is distal to each of the equestrian's knees when the pants garment is worn.

A38. The pants garment of paragraph A37 or A37.1, wherein the lower area of the silicone grip is proximal to the calf panels of each of the right leg portion and the left leg portion.

A39. The pants garment of any of paragraphs A1-A38, wherein the pants garment comprises flatlock stitched seams.

A40. The pants garment of any of paragraphs A1-A39, wherein the lumbar panel comprises a concave down curve.

A41. The pants garment of any of paragraphs A1-A40, wherein the pants garment comprises tights, leggings, or breeches.

A42. The pants garment of any of paragraphs A1-A41, wherein each of the right leg portion and the left leg portion is devoid of seams in a/the respective inner panel region, and wherein each respective inner panel region extends from a respective groin region to an inner calf region of each of the right leg portion and the left leg portion.

A43. The pants garment of any of paragraphs A1-A41, wherein a/the respective inner panel region extends inferiorly along each of the right leg portion and the left leg portion, from a/the groin region of the pants garment, past the equestrian's respective inner knee regions when the pants garment is worn by the equestrian.

A44. The pants garment of any of paragraphs A1-A43, wherein a/the respective inner panel regions extend to respective interfaces with the calf panel of each of the right leg portion and the left leg portion, wherein the respective interfaces are distal to the equestrian's knees when the pants garment is worn by the equestrian.

A45. The pants garment of any of paragraphs A1-A44, wherein the knee stabilization panel is absent in the equestrian's inner knee region.

A46. The pants garment of any of paragraphs A1-A45, wherein each calf panel is at least substantially as wide as the equestrian's lower leg.

A47. The pants garment of any of paragraphs A1-A46, wherein each calf panel extends from a respective lateral side of each of the right leg portion and the left leg portion, to a respective medial side of each of the right leg portion and the left leg portion.

A48. The pants garment of any of paragraphs A1-A47, wherein the calf panels extend across substantially the entire width of the right leg portion and the left leg portion on the posterior side of the pants garment, in the lower leg region of the equestrian's legs.

B1. A pants garment configured to be worn by an equestrian, the pants garment comprising:

a right leg portion and a left leg portion, wherein each of the right leg portion and the left leg portion comprises:

a first portion comprising a base textile, the base textile being a stretchable material that provides a first compressive force to the legs of the equestrian when the pants garment is worn;

a second portion consisting of a mesh textile, the mesh textile being a second stretchable material, wherein the second portion is at least substantially free from overlap with the first portion; and a third portion comprising the base textile overlaid with the mesh textile, such that the third portion provides a second compressive force to the legs of the equestrian when the pants garment is worn, the second compressive force being greater than the first compressive force provided by the first portion, wherein the third portion is at least substantially free from overlap with the first portion and the second portion.

B2. The pants garment of paragraph B1, wherein the pants garment is further devoid of a groin seam in a groin region of the pants garment.

B3. The pants garment of any of paragraphs B1-B2, wherein an inner panel region extends inferiorly along each of the right leg portion and the left leg portion, from a/the groin region of the pants garment, past the equestrian's respective inner knee regions when the pants garment is worn by the equestrian.

B4. The pants garment of any of paragraphs B1-B3, wherein a/the inner panel regions extend to respective interfaces with the second portion of each of the right leg portion and the left leg portion, wherein the respective interfaces are distal to the equestrian's knee when the pants garment is worn by the equestrian.

B5. The pants garment of any of paragraphs B1-B4, wherein the pants garment is devoid of an inseam.

B6. The pants garment of any of paragraphs B1-B5, wherein the mesh textile comprises a texture mesh.

B7. The pants garment of any of paragraphs B1-B6, wherein the second portion of each of the right leg portion and the left leg portion is configured to provide increased breathability as compared to the first portion and the third portion.

B8. The pants garment of any of paragraphs B1-B7, wherein the third portion of each of the right leg portion and the left leg portion is configured to provide body-mapped zoning compression.

B9. The pants garment of any of paragraphs B1-B8, wherein the third portion of each of the right leg portion and the left leg portion is configured to provide muscular support and joint stabilization.

B10. The pants garment of any of paragraphs B1-B9, wherein the pants garment is configured to provide rider-focused protection for the equestrian.

B11. The pants garment of any of paragraphs B1-B10, wherein the third portion of each of the right leg portion and the left leg portion comprises a hip abductor support panel configured to provide support for the equestrian's hip abductor muscles when the pants garment is worn by the equestrian.

B12. The pants garment of paragraph B11, wherein the hip abductor support panels are contoured to generally approximate the equestrian's hip abductor muscles.

B13. The pants garment of any of paragraphs B1-B12, wherein the third portion of each of the right leg portion and the left leg portion comprises a knee stabilization panel configured to provide stabilization for the equestrian's knee joints when the pants garment is worn by the equestrian.

B14. The pants garment of paragraph B13, wherein the knee stabilization panels extend obliquely from the equestrian's upper thighs to the equestrian's outer knees when the pants garment is worn by the equestrian.

B15. The pants garment of paragraph B13 or B14, wherein each of the knee stabilization panels extends superiorly and obliquely from the respective second portion to a/the respective inner panel region of each of the right leg portion and the left leg portion.

B16. The pants garment of any of paragraphs B11-B15, wherein the hip abductor support panels extend from a waist portion of the pants garment to a/the respective knee stabilization panel.

B17. The pants garment of any of paragraphs B1-B16, wherein a/the knee stabilization panel of each of the right leg portion and the left leg portion are configured to provide support and/or reduce fatigue for the equestrian's thigh muscles when the pants garment is worn by the equestrian.

B18. The pants garment of any of paragraphs B1-B17, wherein the third portion of each of the right leg portion and the left leg portion comprises a lumbar panel configured to provide support for the equestrian's lower back, pelvic region, and/or lumbar region when the pants garment is worn by the equestrian.

B19. The pants garment of paragraph B18, wherein the lumbar panel extends across the equestrian's sacrum when the pants garment is worn.

B20. The pants garment of paragraph B18 or B19, wherein the lumbar panel extends laterally to a/the hip abductor support panel of each of the right leg portion and the left leg portion.

B21. The pants garment of any of paragraphs B18-B20, wherein the lumbar panel comprises a concave down curve.

B22. The pants garment of any of paragraphs B1-B21, wherein the second portion is positioned on the equestrian's calves when the pants garment is worn by the equestrian.

B23. The pants garment of any of paragraphs B1-B22, wherein the second portion is positioned on a posterior half of each of the right leg portion and the left leg portion.

B24. The pants garment of any of paragraphs B1-B23, wherein the second portion is distal to the equestrian's knees when the pants garment is worn.

B25. The pants garment of any of paragraphs B1-B24, wherein the base textile comprises a compression knit material.

B26. The pants garment of any of paragraphs B1-B25, wherein the base textile comprises a first percentage of spandex, wherein the mesh textile comprises a second percentage of spandex, and wherein the first percentage is greater than the second percentage.

B27. The pants garment of any of paragraphs B1-B26, wherein the base textile comprises a/the first percentage of spandex, wherein the mesh textile comprises a/the second percentage of spandex, and wherein the first percentage is at least twice the second percentage.

B28. The pants garment of any of paragraphs B1-B27, wherein the base textile comprises a polyester/spandex blend.

B29. The pants garment of any of paragraphs B1-B28, wherein the base textile comprises at least 5% spandex, at least 10% spandex, at least 15% spandex, at least 20% spandex, at least 25% spandex, at least 30% spandex, and/or at least 35% spandex.

B30. The pants garment of any of paragraphs B1-B29, wherein the mesh textile comprises a nylon/spandex blend.

B31. The pants garment of any of paragraphs B1-B30, wherein the mesh textile comprises at least 1% spandex, at least 5% spandex, at least 10% spandex, and/or at least 15% spandex.

B32. The pants garment of any of paragraphs B1-B31, wherein the base textile comprises between 25-30% spandex, and wherein the mesh textile comprises between 10-15% spandex.

B33. The pants garment of any of paragraphs B1-B32, further comprising at least one side pocket formed from an additional layer of the mesh textile.

B34. The pants garment of any of paragraphs B1-B33, further comprising a silicone grip configured for reducing slippage between the pants garment and the equestrian's saddle when the pants garment is worn during horseback riding.

B35. The pants garment of paragraph B34, wherein the silicone grip is positioned within an/the inner panel region of each of the right leg portion and the left leg portion of the pants garment.

B36. The pants garment of paragraph B34 or B35, wherein the silicone grip extends inferiorly from an upper area proximal to each of the equestrian's knees when the pants garment is worn, to a lower area distal to each of the equestrian's knees when the pants garment is worn.

B37. The pants garment of paragraph B36, wherein the lower area of the silicone grip is proximal to the second portion of each of the right leg portion and the left leg portion.

B38. The pants garment of any of paragraphs B1-B37, wherein the pants garment comprises flatlock stitched seams.

B39. The pants garment of any of paragraphs B1-B38, wherein the base textile comprises a four-way stretch material.

B40. The pants garment of any of paragraphs B1-B39, wherein the base textile has an ultraviolet protection factor (UPF) of at least 10, at least 20, at least 30, at least 40, and/or at least 50.

B41. The pants garment of any of paragraphs B1-B40, wherein the base textile is breathable, moisture-wicking, odor-controlling, cooling, and/or anti-microbial.

B42. The pants garment of any of paragraphs B1-B41, wherein the base textile is infused with copper fibers.

B43. The pants garment of any of paragraphs B1-B42, wherein the base textile is configured to radiate energy from the equestrian such that the energy is reflected back to the equestrian in the form of far infrared rays (FIR).

B44. The pants garment of any of paragraphs B1-B43, wherein the pants garment comprises tights, leggings, or breeches.

B45. The pants garment of any of paragraphs B1-B44, wherein each of the right leg portion and the left leg portion is devoid of seams in a/the respective inner panel region.

B46. The pants garment of any of paragraphs B1-B45, wherein the first portion comprises at least 30% of a surface area of the pants garment, at least 40% of the surface area of the pants garment, at least 50% of the surface area of the pants garment, and/or at least 60% of the surface area of the pants garment.

B47. The pants garment of any of paragraphs B1-B46, wherein the second portion comprises at least 5% of a/the surface area of the pants garment, at least 10% of the surface area of the pants garment, at least 15% of the surface area of the pants garment, at least 20% of the surface area of the pants garment, and/or at least 25% of the surface area of the pants garment.

B48. The pants garment of any of paragraphs B1-B47, wherein the third portion comprises at least 10% of a/the surface area of the pants garment, at least 15% of the surface area of the pants garment, at least 20% of the surface area of the pants garment, at least 25% of the surface area of the pants garment, and/or at least 30% of the surface area of the pants garment.

C1. A method of making a pants garment, comprising:

forming a right leg portion and a left leg portion from a base textile having a first compressive force;

forming a respective hip abductor support panel in each of the right leg portion and the left leg portion, wherein each hip abductor support panel extends inferiorly from a waistband portion of the pants garment, wherein the hip abductor support panel is configured to provide compression and support to at least a portion of the equestrian's hip abductor muscle group when the pants garment is worn by the equestrian;

forming a respective knee stabilization panel in each of the right leg portion and the left leg portion, wherein each knee stabilization panel extends inferiorly from an inner thigh of the equestrian to an outer knee area of the equestrian when the pants garment is worn by the equestrian, wherein each knee stabilization panel is configured to provide compression and support to a respective knee joint and quadriceps muscle of the equestrian when the pants garment is worn by the equestrian;

forming a respective calf panel in each of the right leg portion and the left leg portion, wherein each calf panel extends superiorly from a distal end region of each of the right leg portion and the left leg portion, wherein each calf panel is configured to provide compression and support to a respective calf muscle of the equestrian when the pants garment is worn by the equestrian; and forming a lumbar panel positioned on a posterior side of the pants garment, wherein the lumbar panel extends laterally across both the right leg portion and the left leg portion, such that the lumbar panel is configured to provide compression and support to a lumbar region of the equestrian when the pants garment is worn by the equestrian, wherein the hip abductor support panels, the knee stabilization panels, the calf panels, and the lumbar panel comprise a mesh textile having a second compressive force that is greater than the first compressive force.

C2. The method of paragraph C1, wherein the pants garment comprises the pants garment of any of paragraphs A1-A48, and/or the pants garment of any of paragraphs B1-B48.

C3. The method of any of paragraphs C1-C2, wherein the forming the respective hip abductor support panels comprises overlaying the mesh textile onto the base textile in the areas corresponding to the hip abductor support panels.

C4. The method of any of paragraphs C1-C3, wherein the forming the respective hip abductor support panels comprises underlying the mesh textile interiorly to the base textile in the areas corresponding to the hip abductor support panels.

C5. The method of any of paragraphs C1-C4, wherein the forming the respective knee stabilization panels comprises overlaying the mesh textile onto the base textile in the areas corresponding to the knee stabilization panels.

C6. The method of any of paragraphs C1-C5, wherein the forming the respective knee stabilization panels comprises underlying the mesh textile interiorly to the base textile in the areas corresponding to the knee stabilization panels.

C7. The method of any of paragraphs C1-C6, wherein the forming the respective calf panels comprises overlaying the mesh textile onto the base textile in the areas corresponding to the calf panels.

C8. The method of any of paragraphs C1-C7, wherein the forming the respective calf panels comprises underlying the mesh textile interiorly to the base textile in the areas corresponding to the calf panels.

C9. The method of any of paragraphs C1-C8, wherein the forming the respective calf panels comprises securing the mesh textile to the right leg portion and the left leg portion in the areas corresponding to the calf panels, without utilizing the base textile in the calf panels.

C10. The method of any of paragraphs C1-C9, wherein the forming the lumbar panel comprises overlaying the mesh textile onto the base textile in the area corresponding to the lumbar panel.

C11. The method of any of paragraphs C1-C10, wherein the forming the lumbar panel comprises underlying the mesh textile interiorly to the base textile in the area corresponding to the lumbar panel.

C12. The method of any of paragraphs C1-C11, further comprising forming one or more pockets in one or more of the hip abductor support panels, the calf panels, the lumbar panel, the waistband portion, and/or the knee stabilization panels.

C13. The method of any of paragraphs C1-C12, further comprising applying a silicone grip configured for reducing slippage between the pants garment and an equestrian's saddle when the pants garment is worn during horseback riding, wherein the silicone grip is positioned within an inner panel region of each of the right leg portion and the left leg portion of the pants garment.

The various disclosed elements of pants garments disclosed herein are not required to be included in all pants garments according to the present disclosure, and the present disclosure includes all novel and non-obvious combinations and subcombinations of the various elements disclosed herein. Moreover, one or more of the various elements disclosed herein may define independent inventive subject matter that is separate and apart from the whole of a disclosed pants garment. Accordingly, such inventive subject matter is not required to be associated with the pants garments that are expressly disclosed herein, and such inventive subject matter may find utility in pants garments that are not expressly disclosed herein.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A pants garment configured to be worn by an equestrian, the pants garment comprising:

a right leg portion and a left leg portion, wherein each of the right leg portion and the left leg portion comprises: a distal end region;

a hip abductor support panel that extends inferiorly from a waistband portion of the pants garment, wherein the hip abductor support panel is configured to provide compression and support to at least a portion of the equestrian's hip abductor muscle group when the pants garment is worn by the equestrian;

a knee stabilization panel that extends inferiorly from an inner thigh of the equestrian to an outer knee area of the equestrian when the pants garment is worn by the equestrian, wherein the knee stabilization panel is configured to provide compression and support to a respective knee joint and quadriceps muscle of the equestrian when the pants garment is worn by the equestrian;

a calf panel extending superiorly from the distal end region, wherein the calf panel is configured to provide compression and support to a respective calf muscle of the equestrian when the pants garment is worn by the equestrian; and an inner panel region devoid of seams that extends inferiorly from a groin region of the pants garment to an interface with the calf panel, wherein the interface is configured to be distal to a respective knee of the equestrian when the pants garment is worn by the equestrian, and wherein the knee stabilization panel and the hip abductor support panel do not extend into the inner panel region; and a lumbar panel positioned on a posterior side of the pants garment, wherein the lumbar panel extends laterally across both the right leg portion and the left leg portion, such that the lumbar panel is configured to provide compression and support to a lumbar region of the equestrian when the pants garment is worn by the equestrian.

2. The pants garment according to claim 1, wherein the hip abductor support panels, the knee stabilization panels, and the lumbar panel are overlaid onto a base textile from which at least a portion of each of the right leg portion and the left leg portion is formed.

3. The pants garment according to claim 2, wherein the base textile is configured to provide a first compressive force to the equestrian's legs when the pants garment is worn by the equestrian, wherein the hip abductor support panels, the knee stabilization panels, and the lumbar panel are configured to provide a second compressive force to respective areas of the equestrian's legs and the lumbar region of the equestrian when the pants garment is worn by the equestrian, and wherein the second compressive force is greater than the first compressive force.

4. The pants garment according to claim 2, wherein the hip abductor support panels, the knee stabilization panels, the calf panels, and the lumbar panel comprise a mesh textile.

5. The pants garment according to claim 4, wherein the calf panels are positioned on the posterior side of the pants garment, wherein the calf panels each comprises a respective proximal edge region that extends inferiorly and obliquely from a respective lateral side to a respective medial side of the respective proximal edge region, and wherein the calf panels each meet a respective one of the knee stabilization panels at a respective one of the outer knee areas of the equestrian when the pants garment is worn by the equestrian.

6. The pants garment according to claim 1, wherein the hip abductor support panels each extends from the waistband portion and meets, but does not extend past, a respective one of the knee stabilization panels.

7. The pants garment according to claim 1, wherein the lumbar panel extends along the waistband portion of the pants garment on the posterior side of the pants garment.

8. The pants garment according to claim 1, wherein the pants garment comprises a medial interface region where the right leg portion interfaces with the left leg portion on the posterior side of the pants garment, and wherein the lumbar panel extends laterally away from the medial interface region to both the hip abductor support panel of the left leg portion and the hip abductor support panel of the right leg portion.

9. The pants garment according to claim 8, wherein the lumbar panel comprises a concave down curve.

10. The pants garment according to claim 1, wherein each of the right leg portion and the left leg portion comprises:

a first portion comprising a base textile, the base textile being a stretchable material that provides a first compressive force to the legs of the equestrian when the pants garment is worn;

a second portion consisting of a mesh textile, the mesh textile being a second stretchable material, wherein the second portion is at least substantially free from overlap with the first portion; and a third portion comprising the base textile overlaid with the mesh textile, such that the third portion provides a second compressive force to the legs of the equestrian when the pants garment is worn, the second compressive force being greater than the first compressive force provided by the first portion, wherein the third portion is at least substantially free from overlap with the first portion and the second portion.

11. The pants garment according to claim 1, wherein the knee stabilization panel extends inferiorly and obliquely from the inner thigh of the equestrian to the outer knee area of the equestrian when the pants garment is worn by the equestrian.

12. A pants garment configured to be worn by an equestrian, the pants garment comprising:

a right leg portion and a left leg portion, and wherein each of the right leg portion and the left leg portion comprises:

a first portion comprising a base textile, the base textile being a stretchable material that provides a first compressive force to legs of the equestrian when the pants garment is worn;

a second portion consisting of a mesh textile, the mesh textile being a second stretchable material that provides a second compressive force to the legs of the equestrian when the pants garment is worn, wherein the second portion is at least substantially free from overlap with the first portion, and wherein the second portion comprises a calf panel that extends from a lateral side of a respective one of the right and left leg portions to a medial side of the respective leg portion on a posterior side of the pants garment; and a third portion comprising the base textile overlaid with the mesh textile, such that the third portion provides a third compressive force to the legs of the equestrian when the pants garment is worn, the third compressive force being greater than the first compressive force provided by the first portion and greater than the second compressive force provided by the second portion, wherein the third portion is at least substantially free from overlap with the first portion and the second portion, and wherein the third portion comprises a knee stabilization panel configured to provide stabilization for the equestrian's knee joint when the pants garment is worn by the equestrian, and wherein the knee stabilization panel traverses the equestrian's thigh, extending from the equestrian's upper thigh to the equestrian's outer knee, when the pants garment is worn by the equestrian;

wherein the calf panels each comprises a respective proximal edge region that extends inferiorly and obliquely from the lateral side to the medial side of the respective one of the right and left leg portions, and wherein the calf panels each meet a respective one of the knee stabilization panels at a respective one of the equestrian's outer knee areas when the pants garment is worn by the equestrian.

13. The pants garment according to claim 12, wherein a respective inner panel region extends inferiorly along each of the right leg portion and the left leg portion from a groin region of the pants garment, past the equestrian's respective inner knee regions when the pants garment is worn by the equestrian, and wherein the inner panel regions are devoid of seams.

14. The pants garment according to claim 12, wherein the base textile comprises a first percentage of spandex, wherein the mesh textile comprises a second percentage of spandex, and wherein the first percentage is greater than the second percentage.

15. The pants garment according to claim 12, further comprising a silicone grip configured for reducing slippage between the pants garment and the equestrian's saddle when the pants garment is worn during horseback riding, wherein the silicone grip is positioned within an inner panel region of each of the right leg portion and the left leg portion of the pants garment, and wherein the inner panel region is devoid of seams.

16. The pants garment according to claim 12, wherein the third portion of each of the right leg portion and the left leg portion further comprises a hip abductor support panel configured to provide support for the equestrian's hip abductor muscles when the pants garment is worn by the equestrian.

17. The pants garment according to claim 16, wherein each of the knee stabilization panels extends superiorly and obliquely from the respective second portion to a respective inner panel region of each of the right leg portion and the left leg portion.

18. The pants garment according to claim 16 wherein the third portion of each of the right leg portion and the left leg portion comprises a lumbar panel configured to provide support for the equestrian's lower back, pelvic region, and/or lumbar region when the pants garment is worn by the equestrian, and wherein the lumbar panel extends laterally to the hip abductor support panel of each of the right leg portion and the left leg portion.

19. The pants garment according to claim 16, wherein the hip abductor support panels each extends from a waistband portion of the pants garment and meets, but does not extend past, a respective one of the knee stabilization panels.

20. The pants garment according to claim 12, wherein the second portion is distal to the equestrian's knees when the pants garment is worn.

21. The pants garment according to claim 12, wherein the pants garment comprises an inner surface and an outer surface, wherein the base textile extends from the inner surface to the outer surface in the first portion of the pants garment, wherein the mesh textile extends from the inner surface to the outer surface in the second portion of the pants garment, and wherein in the third portion of the pants garment, the inner surface is formed from the base textile and the outer surface is formed from the mesh textile.

22. The pants garment according to claim 12, wherein the calf panels each extend from a respective distal end of a respective one of the right and left leg portions to the equestrian's respective outer knee when the pants garment is worn by the equestrian.

23. A method of making a pants garment, the method comprising:

forming a right leg portion and a left leg portion from a base textile having a first compressive force, wherein the right leg portion and the left leg portion each comprises a respective distal end region;

forming a respective hip abductor support panel in each of the right leg portion and the left leg portion, wherein the hip abductor support panels each extends inferiorly from a waistband portion of the pants garment, wherein the hip abductor support panels are each configured to provide compression and support to at least a portion of an equestrian's hip abductor muscle group when the pants garment is worn by the equestrian;

forming a respective knee stabilization panel in each of the right leg portion and the left leg portion, wherein the knee stabilization panels each extends inferiorly from a respective inner thigh of the equestrian to a respective outer knee area of the equestrian when the pants garment is worn by the equestrian, wherein the knee stabilization panels are each configured to provide compression and support to a respective knee joint and quadriceps muscle of the equestrian when the pants garment is worn by the equestrian;

forming a respective calf panel in each of the right leg portion and the left leg portion, wherein the calf panels each extends superiorly from the respective distal end region, wherein the calf panels are each configured to provide compression and support to a respective calf muscle of the equestrian when the pants garment is worn by the equestrian;

forming a respective inner panel region in each of the right leg portion and the left leg portion, wherein the inner panel regions are each devoid of seams, wherein the inner panel regions each extend inferiorly from a groin region of the pants garment to a respective interface with a respective calf panel, wherein each respective interface is configured to be distal to a respective knee of the equestrian when the pants garment is worn by the equestrian, and wherein each of the respective knee stabilization panels and each of the respective hip abductor support panels do not extend into the respective inner panel regions; and forming a lumbar panel positioned on a posterior side of the pants garment, wherein the lumbar panel extends laterally across both the right leg portion and the left leg portion, such that the lumbar panel is configured to provide compression and support to a lumbar region of the equestrian when the pants garment is worn by the equestrian, wherein the hip abductor support panels, the knee stabilization panels, the calf panels, and the lumbar panel comprise a mesh textile having a second compressive force that is greater than the first compressive force.

24. The method according to claim 23, further comprising:

forming one or more pockets in one or more of the hip abductor support panels, the calf panels, the lumbar panel, the waistband portion, and/or the knee stabilization panels; and applying a silicone grip to the right leg portion and the left leg portion, wherein the silicone grip is configured for reducing slippage between the pants garment and an equestrian's saddle when the pants garment is worn during horseback riding, and wherein the silicone grip is positioned within an inner panel region of each of the right leg portion and the left leg portion of the pants garment.

* * * * *